US011087774B2

(12) United States Patent
Sugiura et al.

(10) Patent No.: US 11,087,774 B2
(45) Date of Patent: Aug. 10, 2021

(54) ENCODING APPARATUS, DECODING APPARATUS, SMOOTHING APPARATUS, INVERSE SMOOTHING APPARATUS, METHODS THEREFOR, AND RECORDING MEDIA

(71) Applicant: NIPPON TELEGRAPH AND TELEPHONE CORPORATION, Chiyoda-ku (JP)

(72) Inventors: Ryosuke Sugiura, Atsugi (JP); Yutaka Kamamoto, Atsugi (JP); Takehiro Moriya, Atsugi (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 0 days.

(21) Appl. No.: 16/617,785

(22) PCT Filed: Apr. 24, 2018

(86) PCT No.: PCT/JP2018/016564
§ 371 (c)(1),
(2) Date: Nov. 27, 2019

(87) PCT Pub. No.: WO2018/225412
PCT Pub. Date: Dec. 13, 2018

(65) Prior Publication Data

US 2020/0194018 A1 Jun. 18, 2020

(30) Foreign Application Priority Data

Jun. 7, 2017 (JP) ..... JP2017-112242

(51) Int. Cl.
*G10L 19/035* (2013.01)

(52) U.S. Cl.
CPC ..... *G10L 19/035* (2013.01)

(58) Field of Classification Search
CPC ..... G10L 19/035
See application file for complete search history.

(56) References Cited

U.S. PATENT DOCUMENTS 8,463,603 B2 * 6/2013 Gao ..... G10L 19/03 704/226
8,731,909 B2 * 5/2014 Yamanashi ..... G10L 19/0204 704/203
9,031,834 B2 * 5/2015 Coorman ..... G10L 21/0364 704/205

FOREIGN PATENT DOCUMENTS

JP 2016200750 * 4/2015 ..... G10L 19/035
WO WO 2007/096551 A2 8/2007

OTHER PUBLICATIONS

Backstrom, Tom et al., "Arithmetic Coding of Speech and Audio Spectra using TCS based on Linear Predictive Spectral Envelopes, " Proc. ICASSP 2015, Apr. 19, 2015, pp. 5127-5131. (Year: 2015).*

(Continued)

*Primary Examiner* — Anne L Thomas-Homescu
(74) *Attorney, Agent, or Firm* — Oblon, McClelland, Maier & Neustadt, L.L.P.

(57) ABSTRACT

A log spectral envelope sequence $L_0, L_1, \ldots, L_{N-1}$ and an envelope code for the log spectral envelope sequence $L_0, L_1, \ldots, L_{N-1}$ are obtained. The log spectral envelope sequence $L_0, L_1, \ldots, L_{N-1}$ is an integer value sequence corresponding to binary logarithms of respective sample values of a spectral envelope sequence and is an integer value sequence whose total sum is 0. For a quantized spectral sequence $\hat{X}_0, \hat{X}_1, \ldots, \hat{X}_{N-1}$, a smoothed spectral sequence $\sim X_0, \sim X_1, \ldots, \sim X_{N-1}$ is obtained by: for $\hat{X}_k$ with $L_k$ being a positive value, adopting $\hat{X}_k$ with $L_k$ digits from its least significant digit removed as $\sim X_k$; for $\hat{X}_k$ with $L_k$ being a negative value, adopting $\hat{X}_k$ with $-L_k$ digits added to its least significant digit in accordance with a predefined (Continued)

rule as $\sim X_k$; and when $L_k$ is 0, adopting $\hat{X}_k$ as $\sim X_k$. The respective samples of the smoothed spectral sequence $\sim X_0$, $\sim X_1, \ldots, \sim X_{N-1}$ are then encoded with a fixed code length to obtain a signal code.

16 Claims, 9 Drawing Sheets

(56) References Cited

OTHER PUBLICATIONS

Moriya, Takehiro et al., "Progress in LPC-Based Frequency-Domain Audio Coding," APSIPA Transactions on Signal and Information Processing, vol. 5, Cambridge University Press, May 31, 2016. (Year: 2016).*

Ferreira, Anibal J.S., "Combined Spectral Envelope Normalization and Subtraction of Sinusoidal Components in the ODFT and MDCT Frequency Domains," Proc. 2001 IEEE Workshop on the Applications of Signal Processing to Audio and Acoustics, Oct. 24, 2001, pp. 51-54. (Year: 2001).*

Backstrom, Tom et al., "Arithmetic Coding of Speech and Audio Spectra using TCS based on Linear Predictive Spectral Envelopes, " Proc. ICASSP 2015, pp. 5127-5131. (Year: 2015).*

International Search Report dated Jul. 17, 2018 in PCT/JP2018/016564 filed Apr. 24, 2018, citing document AX therein, 2 pages.

Baeckstroem et al., "Arithmetic Coding of Speech and Audio Spectra Using TCX Based on Linear Predictive Spectral Envelopes," Proceedings of International Conference on Acoustics, Speech and Signal Processing 2015, Apr. 19, 2015, pp. 5127-5131.

Ryosuke et al., "Spectral-Envelope-Based Least Significant Bit Management for Low-Delay Bit-Error-Robust Speech Coding", NTT Communication Science Labs, IEEE, 2018, pp. 671-675.

* cited by examiner

ENCODING APPARATUS, DECODING APPARATUS, SMOOTHING APPARATUS, INVERSE SMOOTHING APPARATUS, METHODS THEREFOR, AND RECORDING MEDIA

TECHNICAL FIELD

The present invention relates to signal processing techniques such as encoding techniques for time series signals such as audio signals. More particularly, it relates to techniques for smoothing or inverse-smoothing a sample sequence derived from a frequency spectrum of a time series signal, such as an audio signal, based on its spectral envelope values.

BACKGROUND ART

In general, for compression encoding of a sample sequence such as a time series signal, linear predictive analysis is performed on the sample sequence and a code length is appropriately assigned based on the resulting linear predictive coefficients. By doing so, efficient compression encoding is carried out such that distortion in a decoded signal is lessened with a small code amount. One conventional technique for compression encoding of a sample sequence for a speech sound signal is a technique of Non-patent Literature 1.

FIG. 9A is a functional configuration diagram of an encoding apparatus 1011 according to Non-patent Literature 1. The encoding apparatus 1011 according to Non-patent Literature 1 includes: a frequency domain conversion unit 1111 that converts a sample sequence of an input speech sound signal to a frequency spectral sequence $X_0, X_1, \ldots, X_{N-1}$ (where N is a positive integer); a linear predictive analysis unit 1112 that obtains linear predictive coefficients $\alpha_1, \alpha_2, \ldots, \alpha_p$ (where p is the order of linear prediction, being an integer of 2 or greater) and a linear predictive coefficient code $C\alpha$ of predetermined bits corresponding to the linear predictive coefficients $\alpha_1, \alpha_2, \ldots, \alpha_p$ from the frequency spectral sequence $X_0, X_1, \ldots, X_{N-1}$; a spectral envelope generating unit 1113 that obtains a spectral envelope sequence $H_0, H_1, \ldots, H_{N-1}$ corresponding to the linear predictive coefficients $\alpha_1, \alpha_2, \ldots, \alpha_p$; a quantization unit 1115 that obtains a quantized spectral sequence, which is a sequence of integer portions of results of dividing the respective samples of a sequence based on the frequency spectral sequence $X_0, X_1, \ldots, X_{N-1}$ by a quantization step size, and assigns a code length to each sample of the quantized spectral sequence in accordance with the value of a spectral envelope corresponding to that sample and encodes it to obtain a signal code CX, and also obtains a quantization step size code CQ of predetermined bits, which is a code corresponding to the quantization step size; and a multiplexing unit 1117 that multiplexes the linear predictive coefficient code $C\alpha$, the signal code CX, and the quantization step size code CQ together to obtain an output code of the encoding apparatus 1011.

FIG. 9B is a functional configuration diagram of a decoding apparatus 1012 according to Non-patent Literature 1. The decoding apparatus 1012 according to Non-patent Literature 1 includes: a demultiplexing unit 1127 that obtains the output code output by the encoding apparatus 1011 as an input code and outputs the quantization step size code CQ contained in the input code to an inverse quantization unit 1125, the linear predictive coefficient code $C\alpha$ contained in the input code to a spectral envelope generating unit 1123, and the signal code CX contained in the input code to an inverse quantization unit 1125, respectively; a spectral envelope generating unit 1123 that obtains a spectral envelope sequence $H_0, H_1, \ldots, H_{N-1}$ corresponding to the linear predictive coefficient code $C\alpha$ (a code representing a spectral envelope); an inverse quantization unit 1125 that decodes the signal code CX of a code length corresponding to the value of each sample in the spectral envelope sequence $H_0, H_1, \ldots, H_{N-1}$ to obtain the value of each sample of the quantized spectral sequence, decodes the quantization step size code CQ to obtain the quantization step size, and obtains the frequency spectral sequence $X_0, X_1, \ldots, X_{N-1}$ from a sequence obtained by multiplying the values of the respective samples of the quantized spectral sequence by the quantization step size; and a time domain conversion unit 1121 that converts the frequency spectral sequence $X_0, X_1, \ldots, X_{N-1}$ to an output signal, which is a sample sequence in a time domain.

PRIOR ART LITERATURE

Non-Patent Literature

Non-patent Literature 1: T. Backstrom and C. R. Helmrich, "Arithmetic encoding of speech and audio spectra using tcx based on linear predictive spectral envelopes," in Proc. ICASSP 2015, April 2015, pp. 5127-5131.

SUMMARY OF THE INVENTION

Problems to be Solved by the Invention

An encoding scheme in which the code length assigned to each sample depends on the spectral envelope, like the technique of Non-patent Literature 1, is useful under such a condition that an output code output by the encoding apparatus is input to the decoding apparatus as an input code with no error at all. The technique of Non-patent Literature 1 however has problems in that once an error occurs up to a point when the linear predictive coefficient code $C\alpha$ (the code representing the spectral envelope) contained in the output code output by the encoding apparatus is input to the decoding apparatus, an error occurs in the code length of the code corresponding to each sample contained in a signal code and in turn the number of samples to be obtained by decoding changes, thus disrupting a decoding process per se, or in that an output signal completely different from the input signal would be output although the number of samples obtained by decoding happens to be correct. These problems are common not only when the linear predictive coefficient code $C\alpha$ is used as the "code representing the spectral envelope" but more generally in a case where a code generated by encoding of information corresponding to the spectral envelope is used as the "code representing the spectral envelope" and an error occurs in the "code representing the spectral envelope" contained in the output code up to the point when the output code output by the encoding apparatus is input to the decoding apparatus.

An object of the present invention is to enable encoding and decoding that achieves compatibility between efficiently compressing a signal by making use of information on spectral envelopes, that is, lessening distortion in a decoded signal with a small code amount, even under a condition where an error can occur in a code representing the spectral envelope up to the point when a code output by an encoding apparatus is input to a decoding apparatus, and limiting the influence of an error, if any, present in the code representing the spectral envelope within codes input to the decoding apparatus while ensuring that the number of samples to be obtained by decoding is the same as the number of samples that were input to the encoding apparatus.

Means to Solve the Problems

The present invention first obtains a log spectral envelope sequence $L_0, L_1, \ldots, L_{N-1}$, which is an integer value sequence corresponding to binary logarithms of respective sample values of a spectral envelope sequence corresponding to a time series signal in a predetermined time segment and is an integer value sequence whose total sum is 0, and an envelope code which is a code identifying the log spectral envelope sequence. Next, with respect to a quantized spectral sequence $\hat{X}_0, \hat{X}_1, \ldots, \hat{X}_{N-1}$ obtained by quantization of respective sample values of a frequency domain spectral sequence for the time series signal, a smoothed spectral sequence $\sim X_0, \sim X_1, \ldots, \sim X_{N-1}$ is obtained by: for $\hat{X}_k$ (k is sample number, where $k \in \{0, \ldots, N-1\}$) with $L_k$ corresponding to $\hat{X}_k$ being a positive value, adopting $\hat{X}_k$ with $L_k$ digits from its least significant digit in binary removed as a smoothed spectral value $\sim X_k$; for $\hat{X}_k$ with $L_k$ corresponding to $\hat{X}_k$ being a negative value, adopting $\hat{X}_k$ with $-L_k$ digits added to its least significant digit in binary in accordance with a predefined rule as a smoothed spectral value $\sim X_k$; and when $L_k$ corresponding to $\hat{X}_k$ is 0, adopting $\hat{X}_k$ as a smoothed spectral value $\sim X_k$. Then, respective samples of the obtained smoothed spectral sequence $\sim X_0, \sim X_1, \ldots, \sim X_{N-1}$ are encoded with a fixed code length to obtain a signal code. Here, the predefined rule is a rule defined based on an order of sample numbers and an order of digit numbers such that removed digits become digits to be added without excess or deficiency.

Effects of the Invention

This enables efficient compression of a signal by making use of information on spectral envelopes even under a condition where an error can occur in a code representing the spectral envelope up to the point when a code output by an encoding apparatus is input to a decoding apparatus.

DETAILED DESCRIPTION OF THE EMBODIMENTS

Figure 1A:
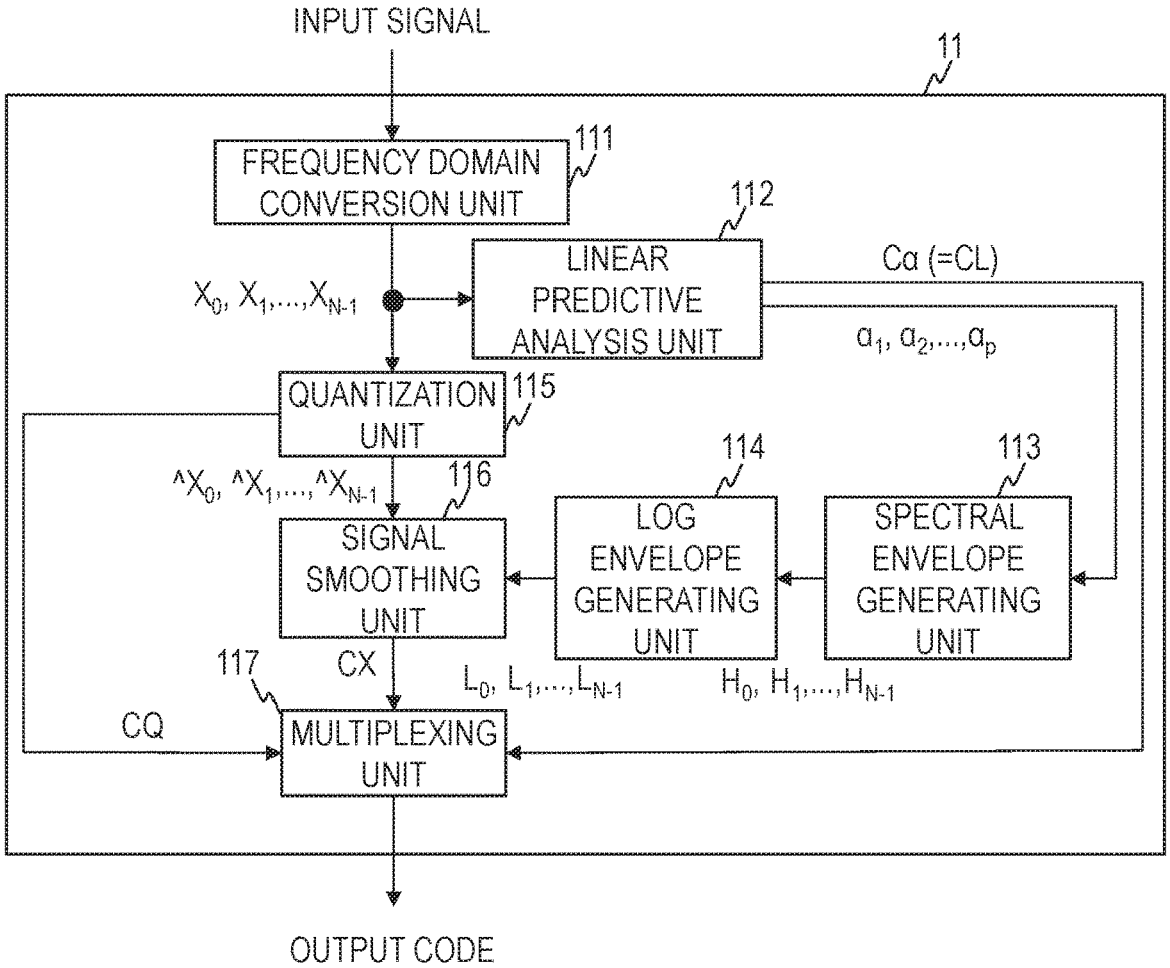
FIG. 1A illustrates a functional configuration diagram of an encoding apparatus according to a first embodiment.

Embodiments of the present invention are now described.

[Principle]

With assignment of a predetermined code length to each sample, it is ensured that the number of samples to be obtained by decoding is the same as the number of samples that were encoded by the encoding apparatus even under a condition where an error can occur in a linear predictive coefficient code up to the point when a code output by the encoding apparatus is input to the decoding apparatus. Specifically, in many cases, for a smoothed spectral sequence obtained by dividing (that is, by smoothing) the respective frequency spectral values of a frequency spectral sequence for a time series signal input to the encoding apparatus by the respective spectral envelope values of a spectral envelope sequence for the time series signal, the amplitude values of smoothed spectra contained in the sequence almost fall within a certain range. Accordingly, it is possible to assign a fixed-length code of a short code length to each sample of the smoothed spectral sequence. In this case, the decoding apparatus is required to perform processing for multiplying each smoothed spectral value of the smoothed spectral sequence obtained by decoding of the code by each spectral envelope value of the spectral envelope sequence (that is, inverse smoothing).

Although not a well-known technique, it is possible to smooth and then quantize the frequency spectrum and assign codes to quantized samples. In that case, a configuration would be such that the encoding apparatus assigns a code to each sample of a sample sequence obtained by quantization of the respective smoothed spectral values of a smoothed spectral sequence, which was obtained by dividing the respective frequency spectral values of the frequency spectral sequence by the respective spectral envelope values of the spectral envelope sequence for the time series signal. With this configuration, a quantization error is increased due to the multiplication of spectral envelopes at the decoding apparatus, leading to a reduced accuracy in reconstruction of the time series signal.

By contrast, although not a well-known technique, it is also possible to quantize and then smooth the frequency spectrum and assign codes to smoothed samples. In that case, the configuration would be such that the respective frequency spectral values of the frequency spectral sequence are quantized to obtain a quantized frequency spectral sequence, which is a sequence with the quantized values, then the respective quantized frequency spectral values of the quantized frequency spectral sequence are divided by the respective spectral envelope values of the spectral envelope sequence to obtain a smoothed and quantized frequency spectral sequence, and then a code is assigned to each sample of the smoothed and quantized frequency spectral sequence. However, since each sample of the smoothed and quantized frequency spectral sequence, which is the result of division, generally is not a value of finite precision, a quantization error would become large if a fixed-length code of a short code length is assigned to each sample of the smoothed and quantized frequency spectral sequence.

Thus, by making use of the fact that the sum of the logarithmic values of the respective spectral envelope values contained in a spectral envelope sequence is approximately 0, the embodiments of the present invention achieve smoothing and inverse smoothing that can ensure compatibility between division and multiplication in an integer area of the spectral envelope sequence corresponding to a quantized spectral sequence that has integer values due to quantization of the respective frequency spectral values of the frequency spectral sequence, and reversibility. Furthermore, by performing encoding and decoding with a fixed-length code assigned to each sample of a smoothed spectral sequence which was obtained by smoothing of the quantized spectral sequence by such division, the embodiments of the present invention achieve signal compression and reconstruction while still ensuring that the number of samples to be obtained by decoding is the same as the number of samples that were input to the encoding apparatus.

The principles of reversible division and multiplication based on spectral envelopes achieved by the embodiments are described below. For a quantized spectral sequence $\hat{X}_0, \hat{X}_1, \ldots, \hat{X}_{N-1}$ of integer values at N points obtained by scalar quantization of the respective frequency spectral values of a frequency spectral sequence $X_0, X_1, \ldots, X_{N-1}$, each of spectral envelope values $H_0, H_1, \ldots, H_{N-1}$ of a spectral envelope sequence representing a shape of its spectral envelope can be represented as shown below using linear predictive coefficients $\alpha_1, \alpha_2, \ldots, \alpha_p$ obtained from the frequency spectral sequence $X_0, X_1, \ldots, X_{N-1}$:

$$H_k = \left| 1 + \sum_{n=1}^{p} \alpha_n \exp(-j2\pi kn/N) \right|^{-1}$$

$$(k = 0, \ldots, N-1)$$

where N is a positive integer and p is an integer of 2 or greater. With • being a real number, exp(•) is an exponential function with the Napier's constant as a base, and j is an imaginary unit. It is known that the sum of logarithmic values of the spectral envelope values $H_0, H_1, \ldots, H_{N-1}$ is approximately 0, and the sum of a logarithmic value $L_k$ of a spectral envelope value $H_k$ to base 2 (=log 2($H_k$), k=0, . . . , N−1) is also nearly 0. Also, when the logarithmic value $L_k$ of a spectral envelope value is an integer value, division $\hat{X}_k/H_k$ of each quantized spectral value of the quantized spectral sequence by a spectral envelope value is equivalent to an operation of increasing or decreasing the digits of a quantized spectral value $\hat{X}_k$ in binary. Using these two natures, division at a signal smoothing unit of an encoding apparatus with no information loss and multiplication at a signal inverse smoothing unit of a decoding apparatus which is reversible with the division and has no information loss are achieved.

First Embodiment

A system according to a first embodiment of the present invention includes an encoding apparatus and a decoding apparatus. The encoding apparatus encodes a time series signal in the time domain which is input in units of frames, for example, an audio signal (sound signal) such as speech and music, to obtain codes and outputs them. The codes output by the encoding apparatus are input to the decoding apparatus. The decoding apparatus decodes the input codes and outputs a time series signal in the time domain in units of frames, for example, an audio signal. In the following, the encoding apparatus and the decoding apparatus are described for a case where the time series signal is an audio signal. An audio signal input to the encoding apparatus is a time series signal generated by picking up sound such as speech or music with a microphone and subjecting it to analog-to-digital conversion, for example. An audio signal output by the decoding apparatus is subjected to digital-to-analog conversion and reproduced via a speaker, thereby becoming audible, for example.

<<Encoding Apparatus 11>>

Figure 1B:
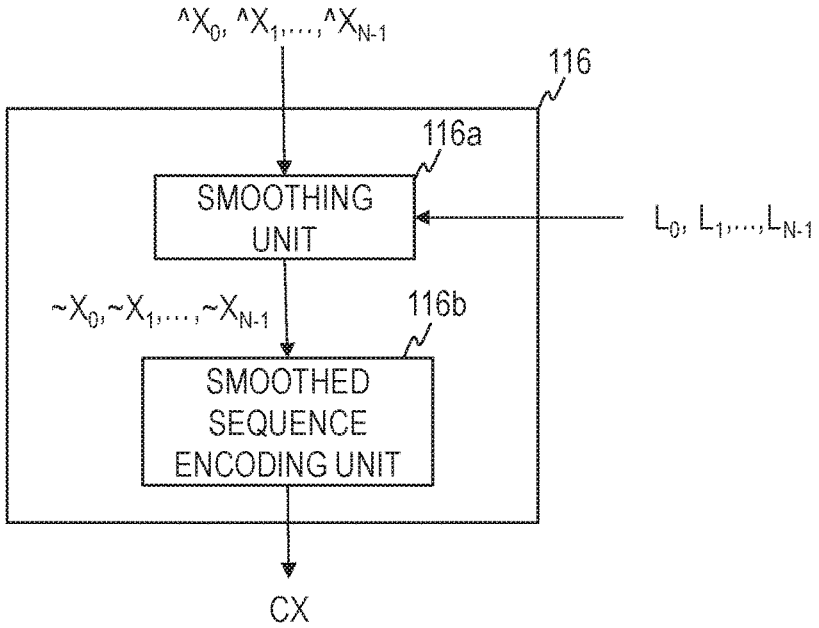
FIG. 1B illustrates a functional configuration diagram of a signal smoothing unit.

With reference to FIGS. 1A and 1B, a functional configuration of an encoding apparatus 11 according to the first embodiment and a processing procedure of an encoding method performed by the encoding apparatus 11 are described.

As illustrated in FIG. 1A, the encoding apparatus 11 includes a frequency domain conversion unit 111, a linear predictive analysis unit 112 (envelope encoding unit), a spectral envelope generating unit 113, a log envelope generating unit 114, a quantization unit 115, a signal smoothing unit 116, and a multiplexing unit 117. The linear predictive analysis unit 112, the spectral envelope generating unit 113, and the log envelope generating unit 114 are included in a "log spectral envelope generating unit".

To the encoding apparatus 11, an audio signal in the time domain (an input signal which is a time series signal) is input. The audio signal is a speech signal or a sound signal, for example. The audio signal in the time domain input to the encoding apparatus 11 is then input to the frequency domain conversion unit 111.

[Frequency Domain Conversion Unit 111]

To the frequency domain conversion unit 111, the audio signal in the time domain input to the encoding apparatus 11 is input. The frequency domain conversion unit 111 converts the input audio signal in the time domain by, for example, modified discrete cosine transform (MDCT) per frame of a predetermined time length (a predetermined time segment) to a frequency spectral sequence $X_0, X_1, \ldots, X_{N-1}$, which is a sequence of samples at N points in a frequency domain, and outputs it. N is a positive integer, for example, N=1024. As a way of conversion to the frequency domain, various well-known conversion methods other than MDCT (for example, discrete Fourier transform, short-time Fourier transform, or the like) may be used. When MDCT is used, the frequency spectral sequence is an MDCT coefficient sequence. The frequency domain conversion unit 111 outputs the frequency spectral sequence $X_0, X_1, \ldots, X_{N-1}$ obtained by conversion to the linear predictive analysis unit 112 and the quantization unit 115. The frequency domain conversion unit 111 may also apply filtering or companding for perceptual weighting to the frequency spectral sequence obtained by conversion and output the sequence after the filtering or companding as the frequency spectral sequence $X_0, X_1, \ldots, X_N$.

[Linear Predictive Analysis Unit 112]

To the linear predictive analysis unit 112, the frequency spectral sequence $X_0, X_1, \ldots, X_{N-1}$ output by the frequency domain conversion unit 111 is input. The linear predictive analysis unit 112 obtains and outputs linear predictive coefficients $\alpha_1, \alpha_2, \ldots, \alpha_p$ corresponding to the input frequency spectral sequence $X_0, X_1, \ldots, X_{N-1}$ and a linear predictive coefficient code Cα (envelope code CL) corresponding to the linear predictive coefficients $\alpha_1, \alpha_2, \ldots, \alpha_p$. An example of the linear predictive coefficient code Cα is a line spectrum pairs (LSP) code, which is a code corresponding to an LSP parameter sequence that corresponds to the linear predictive coefficients $\alpha_1, \alpha_2, \ldots, \alpha_p$, p represents the order of linear prediction, being an integer of 2 or greater. The linear predictive analysis unit 112 outputs the linear predictive coefficients $\alpha_1, \alpha_2, \ldots, \alpha_p$ to the spectral envelope generating unit 113 and the linear predictive coefficient code Cα to the multiplexing unit 117, respectively.

The linear predictive analysis unit 112 obtains linear predictive coefficients, for example, by performing the Levinson-Durbin algorithm on an inverse-Fourier transformed sequence of the squares of the respective values of the input frequency spectral sequence $X_0, X_1, \ldots, X_{N-1}$, and encodes the obtained linear predictive coefficients to obtain the linear predictive coefficient code Cα and outputs it. The linear predictive analysis unit 112 also obtains the quantized values of the linear predictive coefficients corresponding to the obtained linear predictive coefficient code Cα as the linear predictive coefficients $\alpha_1, \alpha_2, \ldots, \alpha_p$ and outputs them.

Generation of the linear predictive coefficient code Cα by the linear predictive analysis unit 112 is performed with a conventional encoding technique, for example. Such a conventional encoding technique can be, for example, an encoding technique that uses a code corresponding to the linear predictive coefficient itself as the linear predictive coefficient code Cα, an encoding technique that converts the linear predictive coefficient to an LSP parameter and uses the code corresponding to the LSP parameter as the linear predictive coefficient code Cα, or an encoding technique that converts the linear predictive coefficient to a PARCOR coefficient and uses the code corresponding to the PARCOR coefficient as the linear predictive coefficient code Cα.

The linear predictive analysis unit 112 may also obtain the linear predictive coefficients $\alpha_1, \alpha_2, \ldots, \alpha_p$ and the linear predictive coefficient code Cα corresponding to the linear predictive coefficients $\alpha_1, \alpha_2, \ldots, \alpha_p$ from an audio signal in the time domain input to the encoding apparatus 11 and output them, rather than from the frequency spectral sequence $X_0, X_1, \ldots, X_{N-1}$ output by the frequency domain conversion unit 111.

[Spectral Envelope Generating Unit 113]

To the spectral envelope generating unit 113, the linear predictive coefficients $\alpha_1, \alpha_2, \ldots, \alpha_p$ output by the linear predictive analysis unit 112 are input. The spectral envelope generating unit 113 uses the input linear predictive coefficients $\alpha_1, \alpha_2, \ldots, \alpha_p$ to obtain a spectral envelope sequence for a time series signal in the predetermined time segment, which is a spectral envelope sequence with the spectral envelope values $H_0, H_1, \ldots, H_{N-1}$ that are determined by Formula (1) below, and outputs it to the log envelope generating unit 114:

$$H_k = \frac{1}{\left|1 + \sum_{n=1}^{p} \alpha_n \exp(-j2\pi kn/N)\right|} \tag{1}$$

where k=0, . . . , N−1, and with • being a real number, exp(•) is an exponential function with the Napier's constant as the base, and j is the imaginary unit.

The spectral envelope generating unit 113 may also obtain the spectral envelope sequence $H_0, H_1, \ldots, H_{N-1}$ from the frequency spectral sequence $X_0, X_1, \ldots, X_{N-1}$ output by the frequency domain conversion unit 111 or from the audio signal in the time domain input to the encoding apparatus 11. In that case, the linear predictive analysis unit 112 may not be provided and the spectral envelope generating unit 113 may obtain and output a code corresponding to the spectral envelope sequence $H_0, H_1, \ldots, H_{N-1}$ as the envelope code CL. As can be seen from the operations of the spectral envelope generating unit 113, the linear predictive coefficient code Cα corresponding to the linear predictive coefficients $\alpha_1, \alpha_2, \ldots, \alpha_p$ obtained by the linear predictive analysis unit 112 is equivalent to the envelope code CL, that is, a code corresponding to the spectral envelope sequence $H_0, H_1, \ldots, H_{N-1}$, and is a code corresponding to the spectral envelope.

[Log Envelope Generating Unit 114]

To the log envelope generating unit 114, the spectral envelope sequence $H_0, H_1, \ldots, H_{N-1}$ output by the spectral envelope generating unit 113 is input. The log envelope generating unit 114 obtains a log spectral envelope sequence $L_0, L_1, \ldots, L_{N-1}$ from the spectral envelope sequence $H_0, H_1, \ldots, H_{N-1}$ and outputs it. Here, the log spectral envelope sequence $L_0, L_1, \ldots, L_{N-1}$ is an integer value sequence corresponding to the binary logarithm of spectral envelope value $H_k$ (where k=0, 1, . . . , N−1), which represents each sample value of the spectral envelope sequence $H_0, H_1, \ldots, H_{N-1}$, and is an integer value sequence whose total sum is 0. For example, the log envelope generating unit 114 performs the processes of steps I to IV shown below to obtain and output the log spectral envelope sequence $L_0, L_1, \ldots, L_{N-1}$.

Step I: The log envelope generating unit 114 determines a logarithmic value $\log_2 H_k$ (where k=0, 1, . . . , N−1) of each of the spectral envelope values $H_0, H_1, \ldots, H_{N-1}$ of the input spectral envelope sequence $H_0, H_1, \ldots, H_{N-1}$ to base 2.

Step II: The log envelope generating unit 114 rounds each logarithmic value $\log_2 H_k$ determined at Step I to an integer value and obtains the sequence with the integer values after being rounded as the log spectral envelope sequence $L_0, L_1, \ldots, L_{N-1}$. The rounding of each logarithmic value $\log_2 H_k$ to an integer value is a process of obtaining an integer value by rounding off the first decimal place of each logarithmic value $\log_2 H_k$ to the closest integer, for example. That is, the log spectral envelope sequence obtained here is an integer value sequence corresponding to the binary logarithms of the respective sample values of the spectral envelope sequence.

Step III: The log envelope generating unit 114 determines the total sum of the log spectral envelope values $L_0, L_1, \ldots, L_{N-1}$, which are the respective sample values of the log spectral envelope sequence obtained at Step II. That is, it determines the total sum of the values contained in the integer value sequence corresponding to the binary logarithms of the respective sample values of the spectral envelope sequence.

Step IV: When the total sum determined at Step III is 0 (that is, when the total sum of the values contained in the integer value sequence corresponding to the binary logarithms of the respective sample values of the spectral envelope sequence is 0), the log envelope generating unit 114 outputs the log spectral envelope sequence $L_0, L_1, \ldots, L_{N-1}$ obtained at Step II to the signal smoothing unit 116. By contrast, when the total sum determined at Step III is not 0 (that is, when the total sum of the values contained in the integer value sequence corresponding to the binary logarithms of the respective sample values of the spectral envelope sequence is not 0), the log envelope generating unit 114 obtains values adjusted so that the total sum becomes 0, for example, values adjusted as described below in (a) and (b), in accordance with a predefined rule as the log spectral envelope sequence $L_0, L_1, \ldots, L_{N-1}$, and outputs it to the signal smoothing unit 116.

(a) When the total sum determined at Step III is greater than 0, the log spectral envelope sequence $L_0, L_1, \ldots, L_{N-1}$ is obtained by subtracting 1 from each value in the log spectral envelope sequence $L_0, L_1, \ldots, L_{N-1}$ starting with the largest value sequentially so that the total sum of the log spectral envelope values contained in the log spectral envelope sequence $L_0, L_1, \ldots, L_{N-1}$ becomes 0. That is, when the total sum of the values contained in the integer value sequence determined at Step III is greater than 0, the log spectral envelope sequence $L_0, L_1, \ldots, L_{N-1}$ is obtained by subtracting 1 from each value in the integer value sequence starting with the largest value sequentially so that the total sum of the values contained in the integer value sequence becomes 0. For example, let $\phi(L_k)=0, \ldots, N-1$ be an index that represents the order (in descending order) of the value of the log spectral envelope value $L_k$ (where $k=0, 1, \ldots, N-1$) contained in the log spectral envelope sequence $L_0, L_1, \ldots, L_{N-1}$ obtained at Step II. Here, the value of $\phi(L_k)$ is smaller for $L_k$ of a greater value. The log envelope generating unit 114 initializes i to i=0 (Step a-1); sets a value $L_{k(i)}-1$, which is obtained by subtracting 1 from $L_{k(i)}$ (where $k(i)=0, \ldots, N-1$) to be adjusted for which $\phi(L_{k(i)})=i$ holds, as a new $L_{k(i)}$ (Step a-2); determines whether the total sum of $L_0, L_1, \ldots, L_{N-1}$ is 0 (Step a-3); if the total sum of $L_0, L_1, \ldots, L_{N-1}$ is not 0, returns to Step a-2 with i+1 as the new i (Step a-4); or if the total sum of $L_0, L_1, \ldots, L_{N-1}$ is 0, outputs the sequence with the current $L_0, L_1, \ldots, L_{N-1}$ to the signal smoothing unit 116 as the log spectral envelope sequence (Step a-5). In case i+1 exceeds N−1 at Step a-4, the log envelope generating unit 114 may return to Step a-1.

(b) When the total sum determined at Step III is smaller than 0, the log spectral envelope sequence $L_0, L_1, \ldots, L_{N-1}$ is obtained by adding 1 to each value in the log spectral envelope sequence $L_0, L_1, \ldots, L_{N-1}$ starting with the smallest value sequentially so that the total sum of the log spectral envelope values contained in the log spectral envelope sequence $L_0, L_1, \ldots, L_{N-1}$ becomes 0. That is, when the total sum of the values contained in the integer value sequence determined at Step III is smaller than 0, the log spectral envelope sequence $L_0, L_1, \ldots, L_{N-1}$ is obtained by adding 1 to each value in the integer value sequence starting with the smallest value sequentially so that the total sum of the values contained in the integer value sequence becomes 0. For example, let $\mu(L_k)=0, \ldots, N-1$ be an index that represents the order (in ascending order) of the value of the log spectral envelope value $L_k$ (where $k=0, 1, \ldots, N-1$) contained in the log spectral envelope sequence $L_0, L_1, \ldots, L_{N-1}$ obtained at Step II. Here, the value of $\mu(L_k)$ is smaller for $L_k$ of a smaller value (for a larger absolute value $|L_k|$). The log envelope generating unit 114 initializes i to i=0 (Step b-1); sets a value $L_{k(i)}+1$, which is obtained by adding 1 to $L_{k(i)}$ (where $k(i)=0, \ldots, N-1$) to be adjusted for which $(L_{k(i)})=i$ holds, as a new $L_{k(i)}$ (Step b-2); determines whether the total sum of $L_0, L_1, \ldots, L_{N-1}$ is 0 (Step b-3); if the total sum of $L_0, L_1, \ldots, L_{N-1}$ is not 0, returns to Step b-2 with i+1 as the new i (Step b-4); or if the total sum of $L_0, L_1, \ldots, L_{N-1}$ is 0, outputs the current $L_0, L_1, \ldots, L_{N-1}$ to the signal smoothing unit 116 as the log spectral envelope sequence (Step b-5). In case i+1 exceeds N−1 at Step b-4, the log envelope generating unit 114 may return to Step b-1.

With (a) and (b) described above, reversibility of multiplication and division can be guaranteed. That is, with (a) and (b) described above, excess or deficiency of digits can be kept from occurring through deletion of digits from each quantized spectral value (division) and addition of digits to each quantized spectral value (multiplication) in the processing at a smoothing unit **116*a* described later. However, (a) and (b) described above are merely an example and are not intended to limit the present invention. If the total sum determined at Step III is not 0, adjustment may be made so that the total sum of the log spectral envelope sequence $L_0, L_1, \ldots, L_{N-1}$ becomes 0 in accordance with some other criterion (for example, a criterion to minimize the distance between the log spectral envelope sequences before and after adjustment), and a log spectral envelope sequence $L_0, L_1, \ldots, L_{N-1}$ whose total sum is 0 may be output to the signal smoothing unit 116. It is an optional matter in which order the log spectral envelope values are adjusted so that their total sum becomes 0 or what value is subtracted from or added to a log spectral envelope value for adjustment when the total sum of the log spectral envelope sequence $L_0, L_1, \ldots, L_{N-1}$ determined at Step III is not 0. In short, the log envelope generating unit 114 should adjust at least some of the values of $L_0, L_1, \ldots, L_{N-1}$ so that the total sum of the log spectral envelope sequence $L_0, L_1, \ldots, L_{N-1}$ obtained at Step II becomes 0, and output the resulting $L_0, L_1, \ldots, L_{N-1}$ to the signal smoothing unit 116. In other words, when the total sum of the values contained in the log spectral envelope sequence $L_0, L_1, \ldots, L_{N-1}$ (an integer value sequence) obtained at Step II is 0, the log envelope generating unit 114 outputs the log spectral envelope sequence $L_0, L_1, \ldots, L_{N-1}$ obtained at Step II to the signal smoothing unit 116 as the log spectral envelope sequence $L_0, L_1, \ldots, L_{N-1}$. By contrast, when the total sum of the values contained in the log spectral envelope sequence $L_0, L_1, \ldots, L_{N-1}$ (an integer value sequence) obtained at Step II is not 0, the log envelope generating unit 114 adjusts at least some of the integer values contained in the integer value sequence in accordance with the predefined rule so that the total sum of the values contained in the integer value sequence after adjustment becomes 0, and outputs the integer value sequence after adjustment to the signal smoothing unit 116** as the log spectral envelope sequence $L_0, L_1, \ldots, L_{N-1}$.

It is desirable to make a minimum adjustment for making the total sum 0 with as little change as possible to the log spectral envelope values $L_0, L_1, \ldots, L_{N-1}$ contained in the log spectral envelope sequence $L_0, L_1, \ldots, L_{N-1}$; it is not preferable to make an adjustment that would significantly change the log spectral envelope values $L_0, L_1, \ldots, L_{N-1}$ contained in the log spectral envelope sequence $L_0, L_1, \ldots, L_{N-1}$. Also, an adjustment that changes all of $L_0, L_1, \ldots, L_{N-1}$ to 0 should not be made. It is necessary to adjust at least some of the values of the log spectral envelope sequence $L_0, L_1, \ldots, L_{N-1}$ so that within the log spectral envelope sequence $L_0, L_1, \ldots, L_{N-1}$, at least any log spectral envelope value of the log spectral envelope values that have been negative values will be a negative value and at least any log spectral envelope values of the log spectral envelope values that have been positive values will be positive values.

[Quantization Unit 115]

To the quantization unit 115, the frequency spectral sequence $X_0, X_1, \ldots, X_{N-1}$ output by the frequency domain conversion unit 111 is input. The quantization unit 115 obtains a quantized spectral sequence $\hat{X}_0, \hat{X}_1, \ldots, \hat{X}_{N-1}$, which is a sequence with the integer-portion values of the results of dividing the respective frequency spectral values of the input frequency spectral sequence $X_0, X_1, \ldots, X_{N-1}$ by the quantization step size, and outputs it to the signal smoothing unit 116. This quantization step size may be determined in a conventional manner. For example, the quantization unit 115 may determine a value proportional to the maximum of energy or amplitude of the input frequency spectral sequence $X_0, X_1, \ldots, X_{N-1}$ as the quantization step size.

The quantization unit 115 obtains a code corresponding to the value of the determined quantization step size and outputs the obtained code to the multiplexing unit 117 as the quantization step size code CQ. The quantization unit 115 may also find using binary search the minimum of the quantization step sizes that allow the quantized spectral sequence $\hat{X}_0, \hat{X}_1, \ldots, \hat{X}_{N-1}$ to be represented by the predetermined bits at the signal smoothing unit 116, thereby determining the value of the quantization step size. In that case, processing to obtain the quantized spectral sequence $\hat{X}_0, \hat{X}_1, \ldots, \hat{X}_{N-1}$ and the quantization step size by the quantization unit 115 and the processing at the signal smoothing unit 116 described later are performed multiple times. The quantization unit 115 outputs the quantization step size code CQ corresponding to the finally determined quantization step size to the multiplexing unit 117, and the signal smoothing unit 116 outputs a signal code CX that corresponds to the smoothed spectral sequence at the time of input of the finally determined quantized spectral sequence $\hat{X}_0, \hat{X}_1, \ldots, \hat{X}_{N-1}$ to the multiplexing unit 117.

[Signal Smoothing Unit 116]

As illustrated in FIG. 1B, the signal smoothing unit 116 includes a smoothing unit 116*a* and a smoothed sequence encoding unit 116*b*, for example. To the signal smoothing unit 116, the quantized spectral sequence $\hat{X}_0, \hat{X}_1, \ldots, \hat{X}_{N-1}$ output by the quantization unit 115 and the log spectral envelope sequence $L_0, L_1, \ldots, L_{N-1}$ output by the log envelope generating unit 114 are input. First, the smoothing unit 116*a* of the signal smoothing unit 116 smoothes the input quantized spectral sequence $\hat{X}_0, \hat{X}_1, \ldots, \hat{X}_{N-1}$ based on the input log spectral envelope sequence $L_0, L_1, \ldots, L_{N-1}$ to obtain a smoothed spectral sequence $\sim X_0, \sim X_1, \ldots, \sim X_{N-1}$ and outputs it. Next, the smoothed sequence encoding unit 116*b* of the signal smoothing unit 116 obtains a signal code CX, which represents the smoothed spectral sequence $\sim X_0, \sim X_1, \ldots, \sim X_{N-1}$ obtained by the smoothing by the smoothing unit 116*a* of the signal smoothing unit 116 in a fixed-length code of predetermined bits, for example, 4 bits per sample, and outputs the signal code CX to the multiplexing unit 117.

The smoothing performed by the smoothing unit 116*a* of the signal smoothing unit 116 is done by manipulating the lower-order digits of each quantized spectral value of the quantized spectral sequence $\hat{X}_0, \hat{X}_1, \ldots, \hat{X}_{N-1}$ in binary at least based on the corresponding log spectral envelope value in the log spectral envelope sequence $L_0, L_1, \ldots, L_{N-1}$.

Specific examples of the smoothing process performed by the smoothing unit 116*a* of the signal smoothing unit 116 are described. For each sample number k (where k=0, . . . , N−1), the smoothing unit 116*a* obtains the smoothed spectral sequence $\sim X_0, \sim X_1, \ldots, \sim X_{N-1}$ by: when the log spectral envelope value $L_k$ corresponding to the quantized spectral value $\hat{X}_k$ is a positive value, adopting the quantized spectral value $\hat{X}_k$ with $L_k$ digits (that is, the same number of digits as the log spectral envelope value $L_k$) from its least significant digit in binary removed as a smoothed spectral value $\sim X_k$; when the log spectral envelope value $L_k$ is a negative value, adopting the quantized spectral value $\hat{X}_k$ with $-L_k$ digits (that is, the same number of digits as the absolute value of the log spectral envelope value $L_k$) from its least significant digit in binary added to as a smoothed spectral value $\sim X_k$; and when the log spectral envelope value $L_k$ is 0, adopting the quantized spectral value $\hat{X}_k$ directly as a smoothed spectral value $\sim X_k$. In doing so, the removed digits are adopted as digits to be added without excess or deficiency in accordance with a predefined rule Rs. That is, the smoothing unit 116*a* obtains the smoothed spectral sequence $\sim X_0, \sim X_1, \ldots, \sim X_{N-1}$ by: for $\hat{X}_k$ (k is sample number, where $k \in \{0, \ldots, N-1\}$) with $L_k$ corresponding to $\hat{X}_k$ being a positive value, adopting $\hat{X}_k$ with $L_k$ digits from its least significant digit in binary removed as the smoothed spectral value $\sim X_k$; for $\hat{X}_k$ with $L_k$ corresponding to $\hat{X}_k$ being a negative value, adopting $\hat{X}_k$ with $-L_k$ digits added to its least significant digit in binary in accordance with the predefined rule Rs as the smoothed spectral value $\sim X_k$; and when $L_k$ corresponding to $\hat{X}_k$ is 0, adopting $\hat{X}_k$ as the smoothed spectral value $\sim X_k$. The predefined rule Rs is a rule defined based on an order of sample numbers and an order of digit numbers such that removed digits become digits to be added without excess or deficiency. Here, a "removed digit" is a digit that is removed from $\hat{X}_k$ with $L_k$ corresponding to $\hat{X}_k$ being a positive value, and a "digit to be added" is a digit that is added to $\hat{X}_k$ with $L_k$ corresponding to $\hat{X}_k$ being a negative value. The predefined rule Rs is for, in accordance with a predefined procedure, adopting any of $L_k$ digits removed from the least significant digit of $\hat{X}_k$ in binary corresponding to a positive log spectral envelope value $L_{k'}$, as any digit to be added to $-L_k$ digits from the least significant digit of $\hat{X}_k$ in binary corresponding to any negative log spectral envelope value $L_{k''}$. Here, k", $k' \in \{0, \ldots, N-1\}$ and k" k' hold. The number of digits in binary to be removed from $\hat{X}_{k'}$ corresponding to a positive log spectral envelope value $L_{k'}$ is the same as the number of digits in binary to be added to $\hat{X}_{k''}$ corresponding to a negative log spectral envelope value $L_{k''}$. A removed digit and a digit to be added are in one-to-one correspondence. That is, every digit removed from $\hat{X}_{k'}$ that corresponds to a positive log spectral envelope value $L_{k'}$ is adopted as any digit to be added to $\hat{X}_k$ that corresponds to any negative log spectral envelope value $L_k$.

Figure 3A:
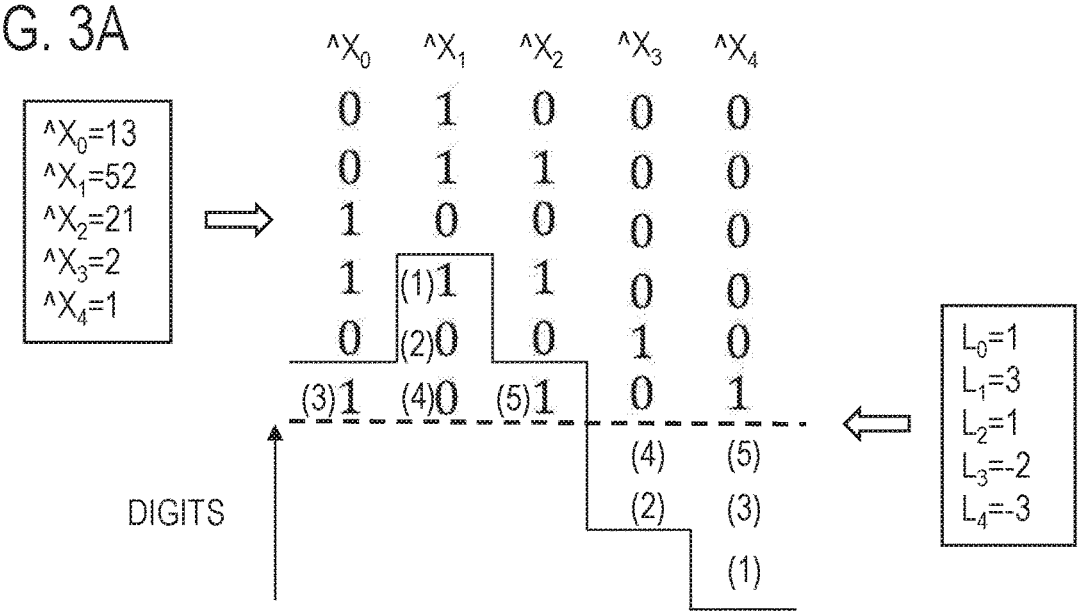
FIG. 3A to FIG. 3C are conceptual diagrams for illustrating processing of a smoothing unit according to the first embodiment.
Figure 3B:
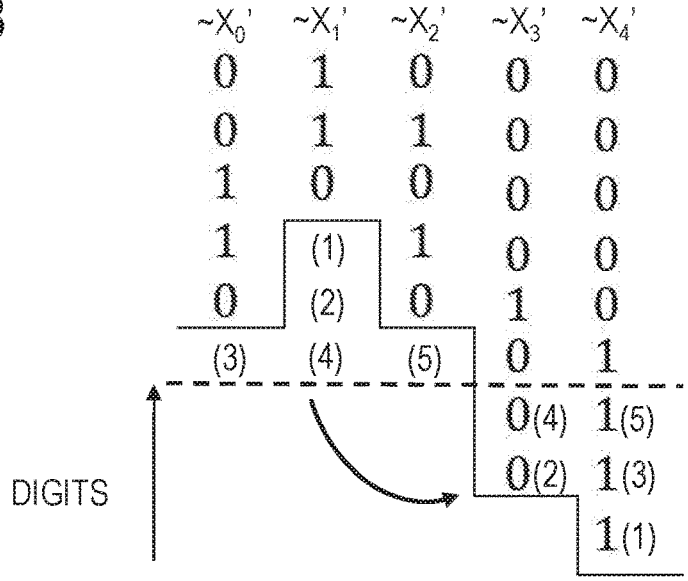
Figure 3C:
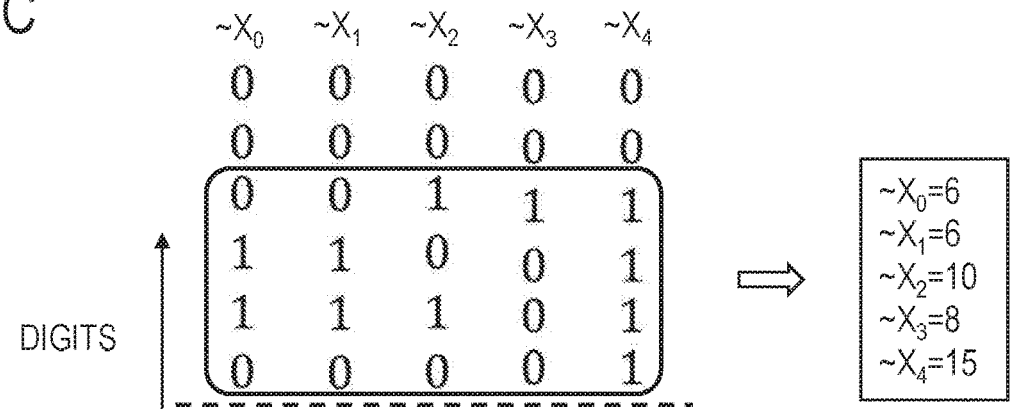

With FIGS. 3A to 3C, an example of the predefined rule Rs is described. The predefined rule Rs illustrated in FIGS. 3A to 3C is a rule that adds, in a quantized spectral sequence, the digits removed from quantized spectral values ($\hat{X}_0, \hat{X}_1, \hat{X}_2$ in the example of FIG. 3A) respectively corresponding to log spectral envelope values that are positive ($L_0, L_1, L_2$ in the example of FIG. 3A) to quantized spectral values ($\hat{X}_3, \hat{X}_4$ in FIG. 3A) corresponding to log spectral envelope values that are negative, such that digits are taken in descending order of magnitude, and for the same order of magnitude, in ascending order of sample number k (where k=0, . . . , 4) in the quantized spectral sequence and placed in ascending order of magnitude, and for the same order of magnitude, in ascending order of sample number k in the smoothed spectral values before digit shift ($\sim X_3', \sim X_4'$ in FIG. 3B) corresponding to the log spectral envelope values that are negative ($L_3, L_4$ in the example of FIG. 3A). The predefined rule Rs described with FIGS. 3A to 3C is merely an example and is not intended to limit the present invention. That is, this example is optional for the present invention.

The example of FIGS. 3A to 3C is described in greater detail. In this example, N=5 holds, and the quantized spectral values of the quantized spectral sequence are $\hat{X}_0=13$, $\hat{X}_1=52$, $\hat{X}_2=21$, $\hat{X}_3=2$, $\hat{X}_4=1$, and the log spectral envelope values of the log spectral envelope sequence are $L_0=1$, $L_1=3$, $L_2=1$, $L_3=-2$, $L_4=-3$. For the quantized spectral value $\hat{X}_0$=13, the corresponding log spectral envelope value is $L_0$=1, so the least significant digit 1 of 0, 0, 1, 1, 0, 1 of the quantized spectral value $\hat{X}_0$ in binary is removed. For the quantized spectral value $\hat{X}_1$=52, the corresponding log spectral envelope value is $L_0$=3, so three digits 1, 0, 0 are removed from the least significant digits of 1, 1, 0, 1, 0, 0 of the quantized spectral value $\hat{X}_1$ in binary. For the quantized spectral value $\hat{X}_2$=21, the corresponding log spectral envelope value is $L_2$=1, so the least significant digit 1 of 0, 1, 0, 1, 0, 1 of the quantized spectral value $\hat{X}_2$ in binary is removed. For the quantized spectral value $\hat{X}_3$=2, the corresponding log spectral envelope value is $L_3$=−2, so two digits are added to the lower-order side of the least significant digit of 0, 0, 0, 0, 1, 0 of the quantized spectral value $\hat{X}_3$ in binary. For the quantized spectral value $\hat{X}_4$=1, the corresponding log spectral envelope value is $L_4$=−3, so three digits are added to the lower-order side of the least significant digit of 0, 0, 0, 0, 0, 1 of the quantized spectral value $\hat{X}_4$ in binary.

Here, according to the aforementioned predefined rule Rs, the ranks among the removed digits are: the third digit 1 from the least significant digit of 1, 1, 0, 1, 0, 0 of the quantized spectral value $\hat{X}_1$=52 in binary is the first (1), the second digit 0 from the least significant digit of 1, 1, 0, 1, 0, 0 of the quantized spectral value $\hat{X}_1$=52 in binary is the second (2), the least significant digit 1 of 0, 0, 1, 1, 0, 1 of the quantized spectral value $\hat{X}_0$=13 in binary is the third (3), the least significant digit 0 of 1, 1, 0, 1, 0, 0 of the quantized spectral value $\hat{X}_1$=52 in binary is the fourth (4), and the least significant digit 1 of 0, 1, 0, 1, 0, 1 of the quantized spectral value $\hat{X}_4$=21 in binary is the fifth (5) (FIG. 3A). On the side of addition, since the rank of the least significant digit of the smoothed spectral value $\sim X_4'$ in binary before digit shift is the first (1), the third digit 1 from the least significant digit in 1, 1, 0, 1, 0, 0 of the quantized spectral value $\hat{X}_1$=52 in binary is added to this digit (FIGS. 3A and 3B). Likewise, since the rank of the least significant digit of the smoothed spectral value $\sim X_3'$ in binary before digit shift is the second (2), the second digit 0 from the least significant digit in 1, 1, 0, 1, 0, 0 of the quantized spectral value $\hat{X}_1$=52 in binary is added to this digit. Likewise, since the rank of the second digit from the least significant digit of the smoothed spectral value $\sim X_4'$ in binary before digit shift is the third (3), the least significant digit 1 in 0, 0, 1, 1, 0, 1 of the quantized spectral value $\hat{X}_0$=13 in binary is added to this digit. Likewise, since the rank of the second digit from the least significant digit of the smoothed spectral value $\sim X_3'$ in binary before digit shift is the fourth (4), the least significant digit 0 in 1, 1, 0, 1, 0, 0 of the quantized spectral value $\hat{X}_1$=52 in binary is added to this digit. Likewise, since the rank of the third digit from the least significant digit of the smoothed spectral value $\sim X_4'$ in binary before digit shift is the fifth (5), the least significant digit 1 in 0, 1, 0, 1, 0, 1 of the quantized spectral value $\hat{X}_2$=21 in binary is added to this digit. Then, a sequence $\sim X_0', \ldots, \sim X_4'$ of the smoothed spectral values before digit shift thus obtained (FIG. 3B) with their least significant digits in binary aligned is obtained as a smoothed spectral sequence $\sim X_0, \ldots, \sim X_4$ (FIG. 3C).

The smoothing process performed by the smoothing unit 116*a* of the signal smoothing unit 116 is processing that achieves compatibility between processing for dividing each quantized spectral value $\hat{X}_1$, of the quantized spectral sequence $\hat{X}_0, \hat{X}_1, \ldots, \hat{X}_{N-1}$ by the corresponding log spectral envelope value $L_k$ and processing for making all of the information contained in the quantized spectral sequence $\hat{X}_0, \hat{X}_1, \ldots, \hat{X}_{N-1}$ be contained in the smoothed spectral sequence $\sim X_0, \sim X_1, \ldots, \sim X_{N-1}$.

In the example of FIGS. 3A to 3C above, the original quantized spectral sequence $\hat{X}_0, \ldots, \hat{X}_4$ is in a range of 6-bit accuracy, whereas the smoothed spectral sequence $\sim X_0, \ldots, \sim X_4$ is substantially represented in a 4-bit range. This allows the smoothed sequence encoding unit 116*b* of the signal smoothing unit 116 to encode each smoothed spectral value $\sim X_k$ of the smoothed spectral sequence $\sim X_0, \ldots, \sim X_4$ obtained by smoothing with a fixed code length of 4 bits to obtain the signal code CX.

Instead of being configured to encode every smoothed spectral value $\sim X_k$ of the smoothed spectral sequence $\sim X_0, \sim X_1, \ldots, \sim X_{N-1}$ with the same number of bits to obtain the signal code CX, the smoothed sequence encoding unit 116*b* of the signal smoothing unit 116 may be configured to encode each smoothed spectral value $\sim X_k$ of the smoothed spectral sequence $\sim X_0, \sim X_1, \ldots, \sim X_{N-1}$ with the predetermined bits per sample position (that is, per sample number k) to obtain the signal code CX. Alternatively, it may be configured to encode each smoothed spectral value of the smoothed spectral sequence $\sim X_0, \sim X_1, \ldots, \sim X_{N-1}$ with the predetermined bits per range of sample positions (that is, per range of the sample number k) to obtain the signal code CX.

[Multiplexing Unit 117]

The multiplexing unit 117 receives the linear predictive coefficient code Cα or the envelope code CL (an envelope code CL, or a code identifying the log spectral envelope sequence $L_0, L_1, \ldots, L_{N-1}$), which is the code representing the spectral envelope, output by the linear predictive analysis unit 112 or the spectral envelope generating unit 113, the quantization step size code CQ output by the quantization unit 115, and the signal code CX output by the signal smoothing unit 116, and outputs an output code that contains all of these codes (for example, an output code obtained by concatenating all the codes together).

<<Decoding Apparatus 12>>

Figure 2A:
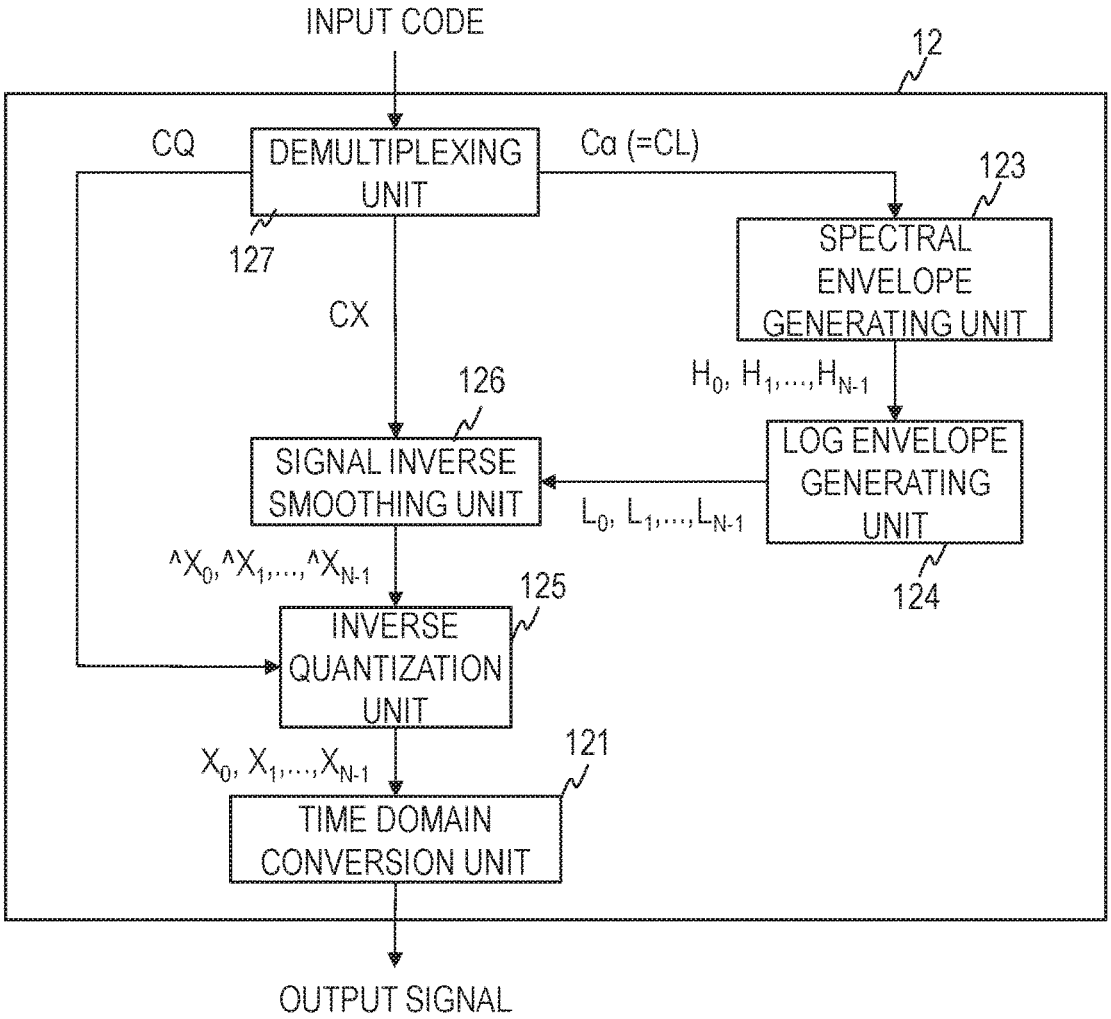
FIG. 2A illustrates a functional configuration diagram of a decoding apparatus according to the first embodiment.
Figure 2B:
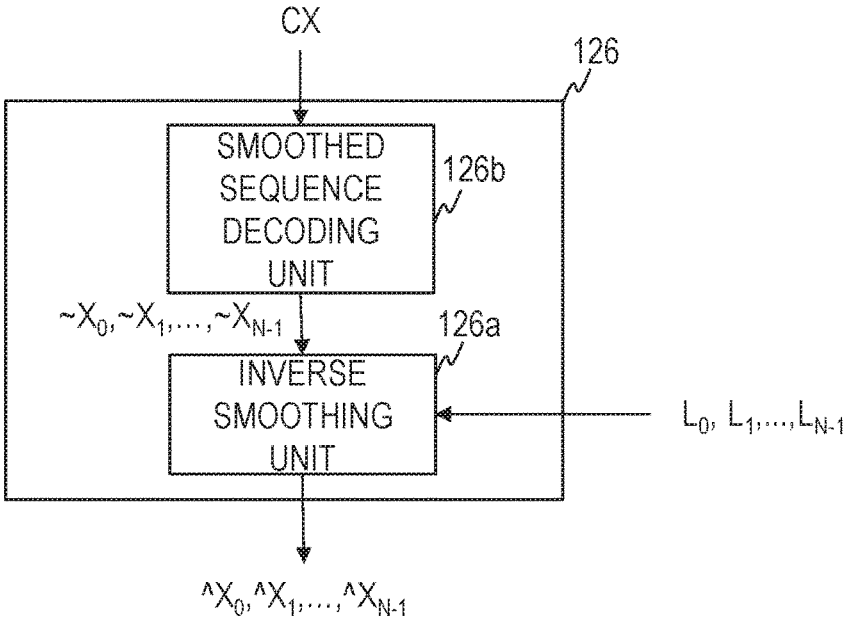
FIG. 2B illustrates a functional configuration diagram of a signal inverse smoothing unit.

With reference to FIGS. 2A and 2B, the functional configuration of a decoding apparatus 12 according to the first embodiment and the processing procedure of a decoding method performed by the decoding apparatus 12 are described.

As illustrated in FIG. 2A, the decoding apparatus 12 includes a time domain conversion unit 121, a spectral envelope generating unit 123, a log envelope generating unit 124, an inverse quantization unit 125, a signal inverse smoothing unit 126, and a demultiplexing unit 127. The spectral envelope generating unit 123 and the log envelope generating unit 124 are included in a "log spectral envelope decoding unit".

To the decoding apparatus 12, an output code output by the encoding apparatus 11 is input as an input code. The input code input to the decoding apparatus 12 is input to the demultiplexing unit 127.

[Demultiplexing Unit 127]

To the demultiplexing unit 127, the input code input to the decoding apparatus 12 is input. The demultiplexing unit 127 receives the input code on a per-frame basis, separates the input code, and outputs the linear predictive coefficient code Cα or the envelope code CL, which is the code representing the spectral envelope, contained in the input code to the spectral envelope generating unit 123, the quantization step size code CQ contained in the input code to the inverse quantization unit 125, and the signal code CX contained in the input code to the signal inverse smoothing unit 126, respectively.

[Spectral Envelope Generating Unit 123]

To the spectral envelope generating unit 123, the linear predictive coefficient code Cα (envelope code CL) output by the demultiplexing unit 127 is input. The spectral envelope generating unit 123 decodes the linear predictive coefficient code Cα to obtain the linear predictive coefficients $\alpha_1$, $\alpha_2$, . . . , $\alpha_p$ by, for example, a conventional decoding technique corresponding to the encoding method performed by the linear predictive analysis unit 112 of the encoding apparatus 11. Further, the spectral envelope generating unit 123 uses the obtained linear predictive coefficients $\alpha_1$, $\alpha_2$, . . . , $\alpha_p$ to generate the spectral envelope sequence $H_0$, $H_1$, . . . , $H_{N-1}$ (that is, decode the envelope code to obtain the spectral envelope sequence) according to the same procedure as that used by the spectral envelope generating unit 113 of the encoding apparatus 11, and outputs it to the log envelope generating unit 124. Here, the conventional decoding technique can be, for example, a technique that decodes the linear predictive coefficient code Cα to obtain the same linear predictive coefficients as the quantized linear predictive coefficients in a case where the linear predictive coefficient code Cα is the code corresponding to the quantized linear predictive coefficients, or a technique that decodes the linear predictive coefficient code Cα to obtain the same LSP parameter as the quantized LSP parameter in a case where the linear predictive coefficient code Cα is the code corresponding to a quantized LSP parameter. It is well known that a linear predictive coefficient and an LSP parameter can be mutually converted and that a conversion process between a linear predictive coefficient and an LSP parameter may be done in accordance with the input linear predictive coefficient code Cα and information required for processing at later stages. From the foregoing, "decoding by a conventional decoding technique" encompasses the decoding process for the linear predictive coefficient code Cα described above and the conversion process which is performed as necessary as described above. In a case where the spectral envelope generating unit 113 of the encoding apparatus 11 obtains the spectral envelope sequence $H_0$, $H_1$, . . . , $H_{N-1}$ and a code corresponding to that spectral envelope sequence as the envelope code CL from the frequency spectral sequence $X_0$, $X_1$, . . . , $X_{N-1}$ or an audio signal in the time domain, the spectral envelope generating unit 113 of the encoding apparatus 11 decodes the envelope code CL by a decoding method corresponding to the method by which the envelope code CL was obtained, thus obtaining the spectral envelope sequence $H_0$, $H_1$, . . . , $H_{N-1}$.

As mentioned above in the description on the spectral envelope generating unit 113 of the encoding apparatus 11, the linear predictive coefficient code Cα is equivalent to the envelope code CL, and the envelope code CL is a code corresponding to the spectral envelope. Thus, the two processes described above, namely, the process to decode the linear predictive coefficient code Cα to obtain linear predictive coefficients and obtain the spectral envelope sequence $H_0$, $H_1$, . . . , $H_{N-1}$ from the obtained linear predictive coefficients and the process to decode the envelope code CL to obtain the spectral envelope sequence $H_0$, $H_1$, . . . , $H_{N-1}$, both amount to a process to obtain the spectral envelope sequence $H_0$, $H_1$, . . . , $H_{N-1}$ from the envelope code CL, which is the code corresponding to the spectral envelope. Accordingly, the spectral envelope generating unit 123 is for obtaining the spectral envelope sequence $H_0$, $H_1$, . . . , $H_{N-1}$ from the envelope code CL, which is the code corresponding to the spectral envelope.

[Log Envelope Generating Unit 124]

To the log envelope generating unit 124, the spectral envelope sequence $H_0$, $H_1$, . . . , $H_{N-1}$ output by the spectral envelope generating unit 123 is input. The log envelope generating unit 124 uses the input spectral envelope sequence $H_0$, $H_1$, . . . , $H_{N-1}$ to obtain the log spectral envelope sequence $L_0$, $L_1$, . . . , $L_{N-1}$ according to the same procedure as that used by the log envelope generating unit 114 of the encoding apparatus 11, and outputs it to the signal inverse smoothing unit 126. That is, the log envelope generating unit 124 obtains an integer value sequence corresponding to the binary logarithm of spectral envelope value $H_k$ (where k=0, 1, . . . , N−1), which represents each sample value of the spectral envelope sequence $H_0$, $H_1$, . . . , $H_{N-1}$. Then, when the total sum of the values contained in the integer value sequence is 0, the log envelope generating unit 124 adopts the integer value sequence as the log spectral envelope sequence $L_0$, $L_1$, . . . , $L_{N-1}$. When the total sum of the values contained in the integer value sequence is not 0, the log envelope generating unit 124 adjusts at least some of the integer values contained in the integer value sequence corresponding to the binary logarithms of the respective sample values of the spectral envelope sequence $H_0$, $H_1$, . . . , $H_{N-1}$ in accordance with a predefined rule so that the total sum of the values contained in the integer value sequence after adjustment becomes 0, and obtains the integer value sequence after adjustment as the log spectral envelope sequence $L_0$, $L_1$, . . . , $L_{N-1}$. As mentioned earlier, the log spectral envelope sequence $L_0$, $L_1$, . . . , $L_{N-1}$ is an integer value sequence corresponding to the binary logarithm of spectral envelope value $H_k$ (where k=0, 1, . . . , N−1), which represents each sample value of the spectral envelope sequence $H_0$, $H_1$, . . . , $H_{N-1}$, and is an integer value sequence whose total sum is 0.

[Signal Inverse Smoothing Unit 126]

As illustrated in FIG. 2B, the signal inverse smoothing unit 126 includes a smoothed sequence decoding unit 126*b* and an inverse smoothing unit 126*a*, for example. To the signal inverse smoothing unit 126, the signal code CX output by the demultiplexing unit 127 and the log spectral envelope sequence $L_0$, $L_1$, . . . , $L_{N-1}$ output by the log envelope generating unit 124 are input. First, the smoothed sequence decoding unit 126*b* of the signal inverse smoothing unit 126 decodes the input signal code CX to obtain the smoothed spectral sequence $\sim X_0$, $\sim X_1$, . . . , $\sim X_{N-1}$ and outputs it. Here, the signal code CX is structured in the same manner as the signal code CX output by the signal smoothing unit 116 of the encoding apparatus 11; that is, it is represented by a fixed-length code of the predetermined bits corresponding to each sample $\sim X_k$ of the smoothed spectral sequence $\sim X_0$, $\sim X_1$, . . . , $\sim X_{N-1}$. This allows the smoothed sequence decoding unit 126*b* to obtain the smoothed spectral value $\sim X_k$, which represents each sample value of the smoothed spectral sequence $\sim X_0$, $\sim X_1$, . . . , $\sim X_{N-1}$, by performing decoding of a fixed code length on the signal code CX.

Next, based on the smoothed spectral sequence $\sim X_0$, $\sim X_1$, . . . , $\sim X_{N-1}$ that was obtained through the decoding by the smoothed sequence decoding unit 126*b* of the signal inverse smoothing unit 126 and on the input log spectral envelope sequence $L_0$, $L_1$, . . . , $L_{N-1}$, the inverse smoothing unit 126*a* of the signal inverse smoothing unit 126 performs inverse smoothing as follows to obtain the quantized spectral sequence $\hat{X}_0$, $\hat{X}_1$, . . . , $\hat{X}_{N-1}$ and outputs it to the inverse quantization unit 125.

The inverse smoothing performed by the inverse smoothing unit 126*a* of the signal inverse smoothing unit 126 is done by manipulating the lower-order digits of each smoothed spectral value of the smoothed spectral sequence $\sim X_0, \sim X_1, \ldots, \sim X_{N-1}$ in binary at least based on the corresponding log spectral envelope value in the log spectral envelope sequence $L_0, L_1, \ldots, L_{N-1}$.

A specific example of the inverse smoothing process performed by the inverse smoothing unit 126*a* of the signal inverse smoothing unit 126 is described. The inverse smoothing unit 126*a* obtains the quantized spectral sequence $\hat{X}_0, \hat{X}_1, \ldots, \hat{X}_{N-1}$ by: for each sample number k (k=0, . . . , N−1), when the log spectral envelope value $L_k$ corresponding to the smoothed spectral value $\sim X_k$ is a negative value, adopting the smoothed spectral value $\sim X_k$ with $-L_k$ digits (that is, the same number of digits as the absolute value of the log spectral envelope value $L_k$) from its least significant digit in binary removed as the quantized spectral value $\hat{X}_k$; when the log spectral envelope value $L_k$ is a positive value, adopting the smoothed spectral value $\sim X_k$ with $L_k$ digits (that is, the same number of digits as the log spectral envelope value $L_k$) from its least significant digit in binary added as the quantized spectral value $\hat{X}_k$; and when the log spectral envelope value $L_k$ is 0, adopting smoothed spectral value $\sim X_k$ directly as the quantized spectral value $\hat{X}_k$. In doing so, the removed digits are adopted as the digits to be added without excess or deficiency in accordance with the rule Rr, which is predefined so as to correspond to the smoothing process performed by the smoothing unit 116*a* of the signal smoothing unit 116 of the encoding apparatus 11. That is, the inverse smoothing unit 126*a* obtains the quantized spectral sequence $\hat{X}_0, \hat{X}_1, \ldots, \hat{X}_{N-1}$ by: for $\hat{X}_k$ with $L_k$ corresponding to $\sim X_1$, being a negative value, adopting $\sim X_k$ with $-L_k$ digits from its least significant digit in binary removed as the quantized spectral value $\hat{X}_k$; for $\hat{X}_k$ with $L_k$ corresponding to $\sim X_k$ being a positive value, adopting $\sim X_k$ with $L_k$ digits added to its least significant digit in binary in accordance with the rule Rr predefined so as to correspond to the smoothing process of the smoothing unit 116*a* as the quantized spectral value $\hat{X}_k$; and when $L_k$ corresponding to $\sim X_k$ is 0, adopting $\sim X_k$ as the quantized spectral value $\hat{X}_k$. The predefined rule Rr is a rule defined based on the order of sample numbers and the order of digit numbers such that removed digits become digits to be added without excess or deficiency. Here, a "removed digit" is a digit that is removed from $\hat{X}_k$ with $L_k$ corresponding to $\hat{X}_k$ being a negative value, and a "digit to be added" is a digit that is added to $\hat{X}_k$ with $L_k$ corresponding to $\hat{X}_k$ being a positive value. The predefined rule Rr is for, in accordance with a predefined procedure, adopting any of $-L_k$ digits removed from the least significant digit of $\sim X_{k'}$ in binary corresponding to a negative log spectral envelope value $L_{k'}$, as any digit to be added to $L_{k''}$ digits from the least significant digit of $\sim X_{k''}$ in binary corresponding to any positive log spectral envelope value $L_{k''}$. Here, k", k'∈{0, . . . , N−1} and k"≠k' hold. The predefined rule Rr must correspond to the predefined rule Rs described above. In other words, the inverse smoothing which is performed by the inverse smoothing unit 126*a* of the signal inverse smoothing unit 126 in accordance with the predefined rule Rr has to be the inverse process of the smoothing which is performed by the smoothing unit 116*a* of the signal smoothing unit 116 in accordance with the predefined rule Rs described above. The number of digits in binary to be removed from $\sim X_{k'}$ corresponding to a negative log spectral envelope value $L_{k'}$ is the same as the number of digits in binary to be added to $\sim X_{k''}$ corresponding to a positive log spectral envelope value $L_{k''}$. A removed digit and a digit to be added are in one-to-one correspondence. That is, every digit removed from $\sim X_{k'}$ that corresponds to a negative log spectral envelope value $L_{k'}$ is adopted as any digit to be added to $\sim X_k$ that corresponds to any positive log spectral envelope value $L_{k''}$.

Figure 4A:
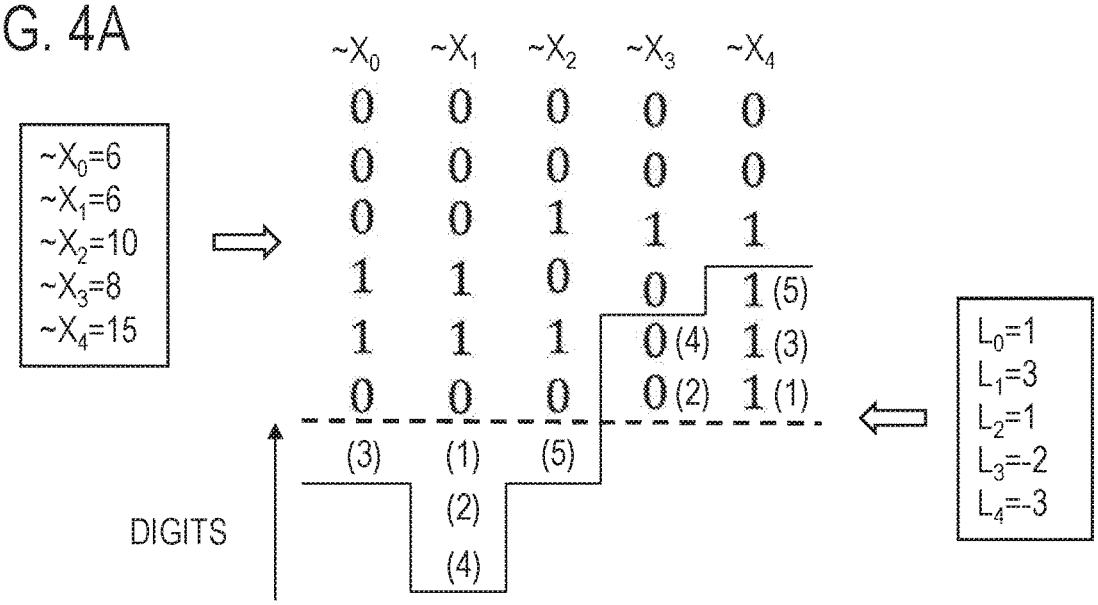
FIGS. 4A to 4C are conceptual diagrams for illustrating processing of an inverse smoothing unit according to the first embodiment.
Figure 4B:
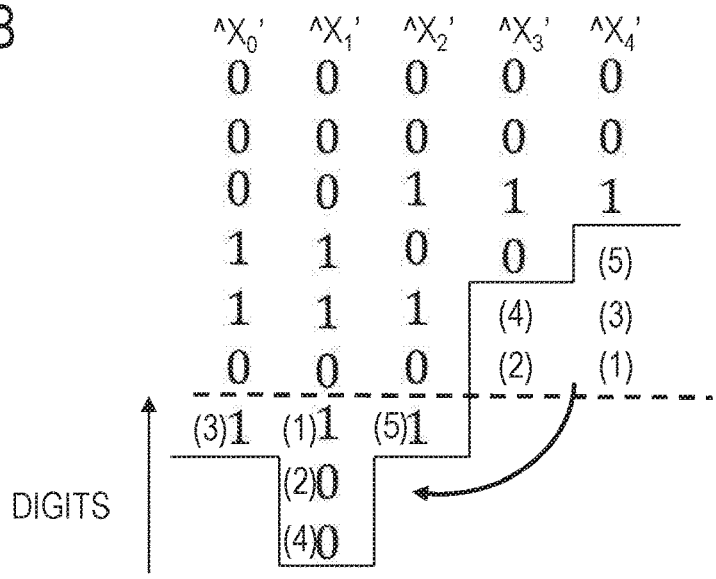
Figure 4C:
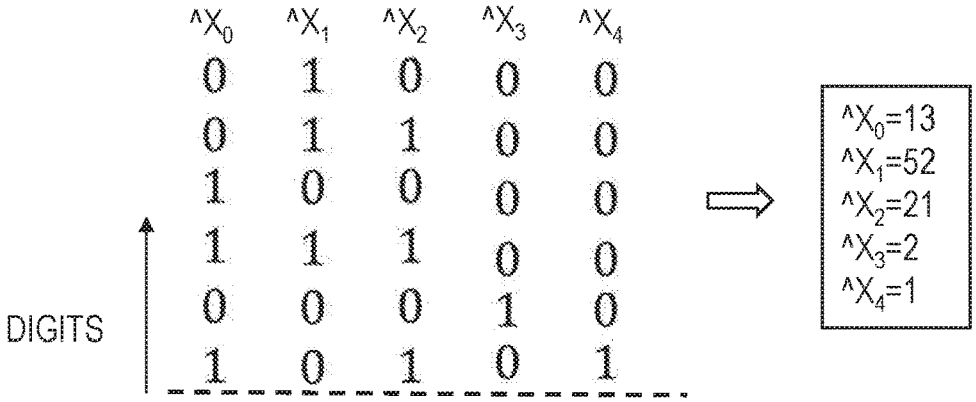

With FIGS. 4A to 4C, an example of the predefined rule Rr is described. The predefined rule Rr illustrated in FIGS. 4A to 4C is a rule predefined so as to correspond to the smoothing process performed by the smoothing unit 116*a* of the signal smoothing unit 116 of the encoding apparatus 11 illustrated in FIGS. 3A to 3C. The predefined rule Rr is a rule that adds, in a smoothed spectral sequence, the digits removed from smoothed spectral values ($\sim X_3$, $\sim X_4$ in the example of FIG. 4A) respectively corresponding to log spectral envelope values that are negative ($L_3$, $L_4$ in the example of FIG. 4A) to smoothed spectral values corresponding to log spectral envelope values that are positive ($\sim X_0$, $\sim X_1$, $\sim X_2$ in the example of FIG. 4A), such that digits are taken in ascending order of magnitude, and for the same order of magnitude, in descending order of sample number k in the smoothed spectral sequence and placed in descending order of magnitude, and for the same order of magnitude, in ascending order of sample number k in the quantized spectral values before digit shift ($\hat{X}_0'$, $\hat{X}_1'$, $\hat{X}_2'$ in the example of FIG. 4B). The predefined rule Rr described with FIGS. 4A to 4C is merely an example and is not intended to limit the present invention. That is, this example is optional for the present invention.

The example of FIGS. 4A to 4C is described in greater detail. In this example, N=5 holds, and the smoothed spectral values of the smoothed spectral sequence are $\sim X_0=6$, $\sim X_1=6$, $\sim X_2=10$, $\sim X_3=8$, $\sim X_4=15$, and the log spectral envelope values of the log spectral envelope sequence are $L_0=1$, $L_1=3$, $L_2=1$, $L_3=-2$, $L_4=-3$. For the smoothed spectral value $\sim X_0=6$, the corresponding log spectral envelope value is $L_0=1$, so one digit is added to the lower-order side of the least significant digit of 0, 0, 0, 1, 1, 0 of the smoothed spectral value $\sim X_0$ in binary. For the smoothed spectral value $\sim X_1=6$, the corresponding log spectral envelope value is $L_1=3$, so three digits are added to the lower-order side of the least significant digit of 0, 0, 0, 1, 1, 0 of the smoothed spectral value $\sim X_1$ in binary. For the smoothed spectral value $\sim X_2=10$, the corresponding log spectral envelope value is $L_2=1$, so one digit is added to the lower-order side of the least significant digit of 0, 0, 1, 0, 1, 0 of the smoothed spectral value $\sim X_2$ in binary. For the smoothed spectral value $\sim X_3=8$, the corresponding log spectral envelope value is $L_3=-2$, so two digits 0, 0 are removed from the least significant digits of 0, 0, 1, 0, 0, 0 of the smoothed spectral value $\sim X_3$ in binary. For the smoothed spectral value $\sim X_4=15$, the corresponding log spectral envelope value is $L_4=-3$, so three digits 1, 1, 1 are removed from the least significant digit of 0, 0, 1, 1, 1, 1 of the smoothed spectral value $\sim X_4$ in binary.

Here, according to the aforementioned predefined rule Rr, the ranks among the removed digits are: the least significant digit 1 of 0, 0, 1, 1, 1, 1 of the smoothed spectral value $\sim X_4$ in binary is the first (1), the least significant digit 0 of 0, 0, 1, 0, 0, 0 of the smoothed spectral value $\sim X_3$ in binary is the second (2), the second digit 1 from the least significant digit of 0, 0, 1, 1, 1, 1 of the smoothed spectral value $\sim X_4$ in binary is the third (3), the second digit 0 from the least significant digit of 0, 0, 1, 0, 0, 0 of the smoothed spectral value $\sim X_3$ in binary is the fourth (4), and the third digit 1 from the least significant digit of 0, 0, 1, 1, 1, 1 of the smoothed spectral value $\sim X_4$ in binary is the fifth (5). On the side of addition, since the rank of the third digit from the least significant digit of the quantized spectral value $\hat{X}_1$ in binary is the first (1), the least significant digit 1 in 0, 0, 1, 1, 1, 1 of the smoothed spectral value $\sim X_4$ in binary is added to this digit. Likewise, since the rank of the second digit from the least significant digit of the quantized spectral value $\hat{X}_1$ in binary is the second (2), the least significant digit 0 in 0, 0, 1, 0, 0, 0 of the smoothed spectral value $\sim X_3$ in binary is added to this digit. Likewise, since the rank of the least significant digit of the quantized spectral value $\hat{X}_0$ in binary is the third (3), the second digit 1 from the least significant digit in 0, 0, 1, 1, 1, 1 of the smoothed spectral value $\sim X_4$ in binary is added to this digit. Likewise, since the rank of the least significant digit of the quantized spectral value $\hat{X}_1$ in binary is the fourth (4), the second digit 0 from the least significant digit in 0, 0, 1, 0, 0, 0 of the smoothed spectral value $\sim X_3$ in binary is added to this digit. Likewise, since the rank of the least significant digit of the quantized spectral value $\hat{X}_2$ in binary is the fifth (5), the third digit 1 from the least significant digit in 0, 0, 1, 1, 1, 1 of the smoothed spectral value $\sim X_4$ in binary is added to this digit.

The inverse smoothing process performed by the inverse smoothing unit 126*a* of the signal inverse smoothing unit 126 is processing that achieves compatibility between processing for multiplying each smoothed spectral value $\sim X_k$ of the smoothed spectral sequence $\sim X_0, \sim X_1, \ldots, \sim X_{N-1}$ by the corresponding log spectral envelope value $L_k$ and processing for making all of the information contained in the smoothed spectral sequence $\sim X_0, \sim X_1, \ldots, \sim X_{N-1}$ be contained in the quantized spectral sequence $\hat{X}_0, \hat{X}_1, \ldots, \hat{X}_{N-1}$, and is processing corresponding to the smoothing process performed by the smoothing unit 16*a* of the signal smoothing unit 116 of the encoding apparatus 11.

The smoothed sequence decoding unit 126*b* of the signal inverse smoothing unit 126 may perform a decoding process corresponding to the smoothed sequence encoding unit 116*b* of the signal smoothing unit 116 of the encoding apparatus 11. That is, the smoothed sequence decoding unit 126*b* of the signal inverse smoothing unit 126 may be configured to decode the signal code CX with the same number of bits for all the samples to obtain each smoothed spectral value $\sim X_k$ of the smoothed spectral sequence $\sim X_0, \sim X_1, \ldots, \sim X_{N-1}$, may be configured to decode the signal code CX with the predetermined bits per sample position to obtain each smoothed spectral value $\sim X_k$ of the smoothed spectral sequence $\sim X_0, \sim X_1, \ldots, \sim X_{N-1}$, or may be configured to decode the signal code CX with the predetermined bits per range of sample positions to obtain each smoothed spectral value $\sim X_k$ of the smoothed spectral sequence $\sim X_0, \sim X_1, \ldots, \sim X_{N-1}$.

[Inverse Quantization Unit 125]

To the inverse quantization unit 125, the quantization step size code CQ output by the demultiplexing unit 127 and the quantized spectral sequence $\hat{X}_0, \hat{X}_1, \ldots, \hat{X}_{N-1}$ output by the signal inverse smoothing unit 126 are input. The inverse quantization unit 125 decodes the input quantization step size code CQ to obtain the quantization step size. The inverse quantization unit 125 also obtains a decoded spectral sequence $X_0, X_1, \ldots, X_{N-1}$, which is a sequence of the samples determined by multiplication of the respective quantized spectral values of the input quantized spectral sequence $\hat{X}_0, \hat{X}_1, \ldots, \hat{X}_{N-1}$ by the quantization step size obtained by the decoding, and outputs it to the time domain conversion unit 121. That is, the inverse quantization unit 125 inverse-quantizes the quantized spectral sequence $\hat{X}_0, \hat{X}_1, \ldots, \hat{X}_{N-1}$ to obtain the decoded spectral sequence $X_0, X_1, \ldots, X_{N-1}$ (a frequency domain spectral sequence) and outputs it to the time domain conversion unit 121. In other words, the inverse quantization unit 125 inverse-quantizes the quantized spectral sequence $\hat{X}_0, \hat{X}_1, \ldots, \hat{X}_{N-1}$ to obtain the decoded spectral sequence $X_0, X_1, \ldots, X_{N-1}$ (the frequency domain spectral sequence), which is a sequence of decoded frequency domain spectra for the predetermined time segment, and outputs it to the time domain conversion unit 121.

[Time Domain Conversion Unit 121]

To the time domain conversion unit 121, the decoded spectral sequence $X_0, X_1, \ldots, X_{N-1}$ output by the inverse quantization unit 125 is input. The time domain conversion unit 121 converts, on a per-frame basis, the decoded spectral sequence $X_0, X_1, \ldots, X_{N-1}$, which is a sequence of samples at N points in the frequency domain, to a signal in the time domain using inverse conversion (for example, inverse MDCT) corresponding to the frequency domain conversion unit 111 of the encoding apparatus 11, to obtain an audio signal (a decoded audio signal) in units of frames, and outputs it as an output signal. In a case where filtering or companding for perceptual weighting has been applied to the frequency spectral sequence obtained by conversion at the frequency domain conversion unit 111 of the encoding apparatus 11, the time domain conversion unit 121 first applies inverse conversion corresponding to the filtering or companding that was performed by the encoding apparatus 11 to the decoded spectral sequence $X_0, X_1, \ldots, X_{N-1}$, converts the sequence after the inverse conversion to a signal in the time domain, and outputs it. That is, the time domain conversion unit 121 converts the frequency domain spectral sequence to the time domain to obtain a decoded time series signal for the predetermined time segment.

<<Case of Error Occurrence>>

Figure 5A:
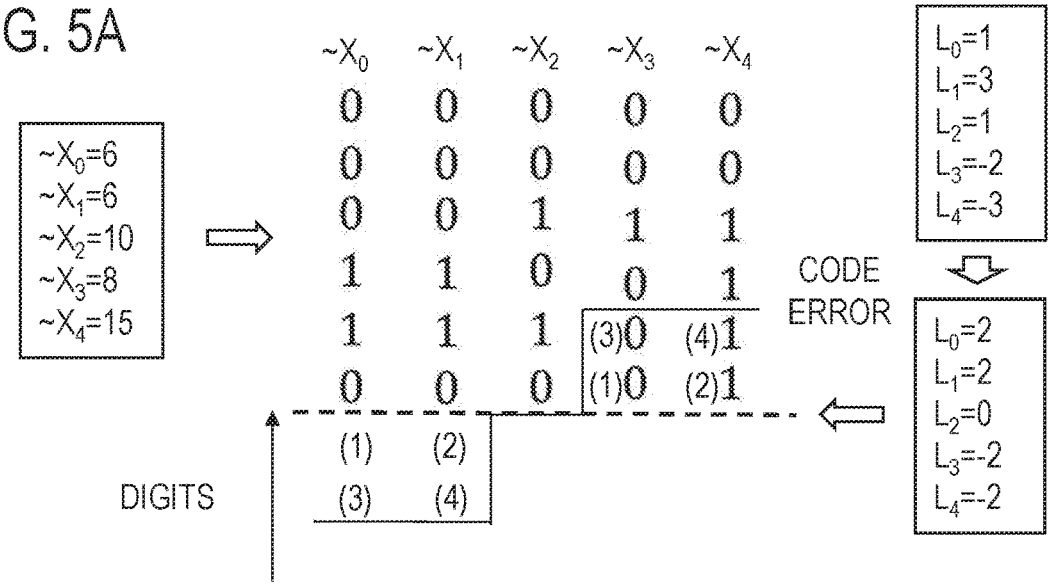
FIGS. 5A to 5C are conceptual diagrams for illustrating the influence of a code error occurring in an output code obtained in the first embodiment.
Figure 5B:
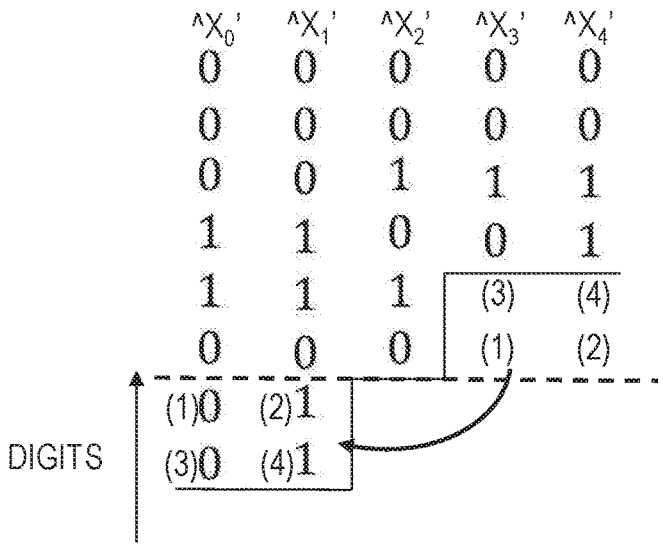
Figure 5C:
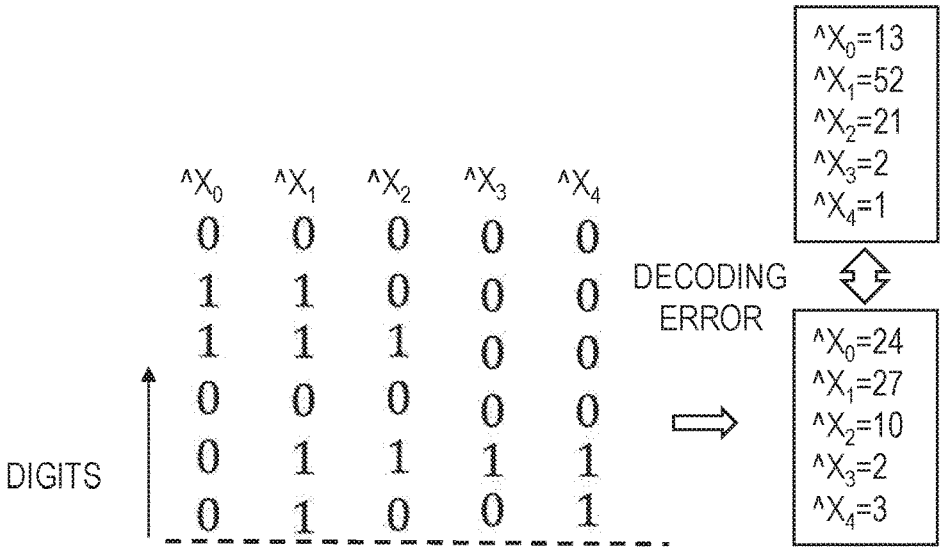

Description is given on an example where an error occurs up to the point when an output code output by the encoding apparatus 11 in the first embodiment is input to the decoding apparatus 12 with FIGS. 5A to 5C. This example assumes that no error is present in the signal code CX contained in the input code, and the correct smoothed spectral sequence $\sim X_0=6$, $\sim X_1=6$, $\sim X_2=10$, $\sim X_3=8$, $\sim X_4=15$ is obtained by decoding of the signal code CX, but an error is present in the linear predictive coefficient code Cα (the code representing the spectral envelope) contained in the input code, so that the log spectral envelope sequence obtained by decoding of the linear predictive coefficient code Cα is $L_0=2$, $L=2$, $L_2=0$, $L_3=-2$, $L_4=-2$, as opposed to the correct log spectral envelope sequence $L_0=1$, $L_1=3$, $L_2=1$, $L_3=-2$, $L_4=-3$. In this case, for the smoothed spectral value $\sim X_0=6$, since the corresponding log spectral envelope value is $L_0=2$, two digits will be added to it. For the smoothed spectral value $\sim X_1=6$, since the corresponding log spectral envelope value is $L=2$, two digits will be added to it. For the smoothed spectral value $\sim X_2=10$, since the corresponding log spectral envelope value is $L_2=0$, no addition or deletion of digits will be made. For the smoothed spectral value $\sim X_3=8$, since the corresponding log spectral envelope value is $L_3=-2$, two digits 0, 0 from the least significant will be removed. For the smoothed spectral value $\sim X_4=15$, since the corresponding log spectral envelope value is $L_4=-2$, two digits 1, from the least significant digit will be removed (FIG. 5A). The four removed digits are added to the smoothed spectral value $\sim X_0$ and to the smoothed spectral value $\sim X_1$ in accordance with the aforementioned predefined rule Rr (FIG. 5B), resulting in quantized spectral values $\hat{X}_0=24$, $\hat{X}_1=27$, $\hat{X}_2=10$, $\hat{X}_3=2$, $\hat{X}_4=3$ (FIG. 5C). Although the resulting quantized spectral values are not correct, only an error of a similar level to the error in the log spectral envelope values occurs in the quantized spectral values. For example, if the value of a log spectral envelope increases by 1 due to an error, this is equivalent to doubling of the corresponding spectral envelope value. If inverse smoothing is performed with this incorrect envelope, the error in the quantized spectral value obtained by decoding would be about double the original value at most. As another example, if the value of a log spectral envelope decreases by 1 due to an error, this is equivalent to halving of the corresponding spectral envelope value. If inverse smoothing is performed with this incorrect envelope, the error in the quantized spectral value obtained by decoding would be about half the original value at most. In addition, an error never occurs in the number of samples in the quantized spectral sequence however much error occurs in the linear predictive coefficient code Cα.

Although not illustrated, when an error is present in the signal code CX contained in the input code, an error occurs in smoothed spectral values that have errors in codes within the smoothed spectral sequence obtained by the decoding of the signal code CX, but no error occurs in smoothed spectral values having no errors in codes. That is, the error of the signal code CX only affects the smoothed spectral values to which bits with errors in the signal code CX correspond. In addition, an error never occurs in the number of samples in the quantized spectral sequence however much error occurs in the signal code CX.

Second Embodiment

When the frame is sufficiently short, that is, when the aforementioned N is small (for example, when N=32), implementation can be done with a less amount of computation by directly determining the log spectral envelope sequence from the frequency spectral sequence, than by determining the linear predictive coefficients from the frequency spectral sequence and then determining the log spectral envelope sequence corresponding to the determined linear predictive coefficients. A second embodiment describes an encoding apparatus that obtains a log spectral envelope sequence by vector quantization as a way of directly determining the log spectral envelope sequence from the frequency spectral sequence, and a decoding apparatus corresponding to the encoding apparatus.

<<Encoding Apparatus 21>>

Figure 6A:
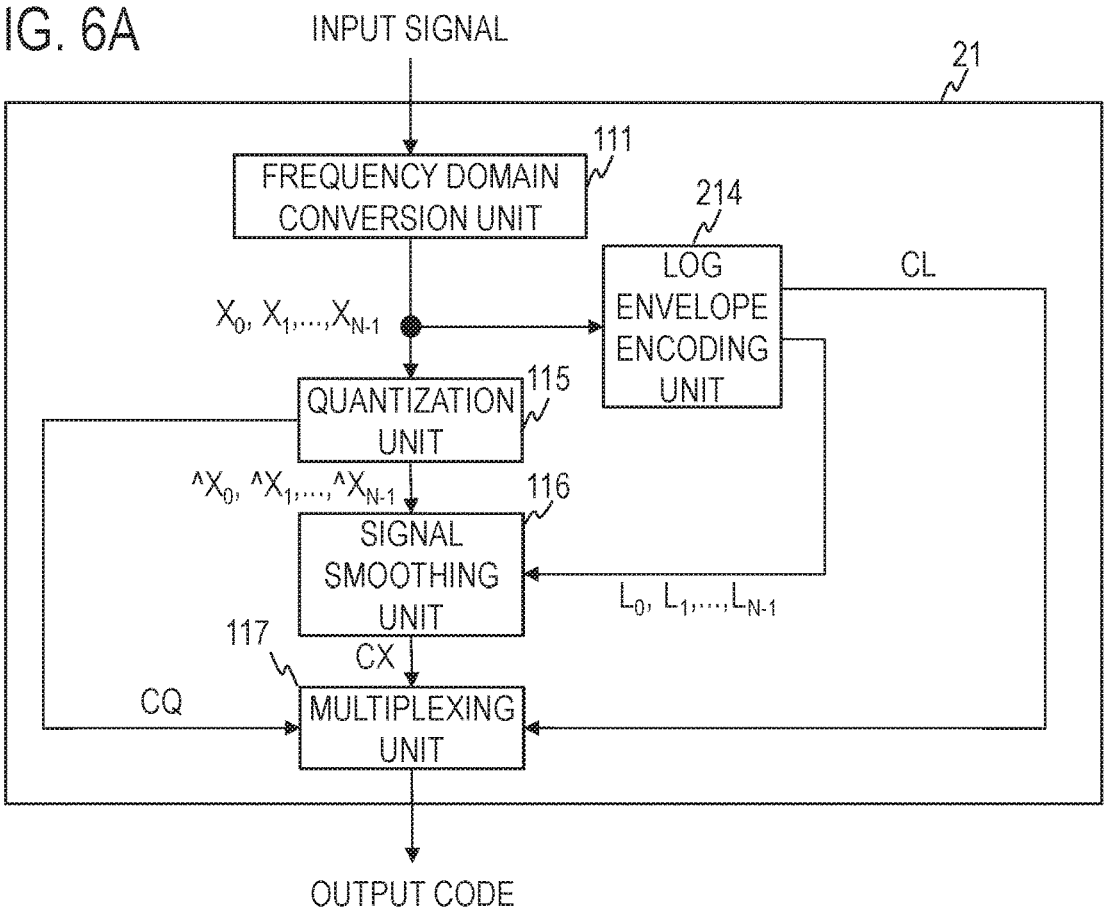
FIG. 6A is a functional configuration diagram of an encoding apparatus according to a second embodiment.

With reference to FIG. 6A, the processing procedure of an encoding method performed by an encoding apparatus 21 according to the second embodiment is described. The encoding apparatus 21 according to the second embodiment has the same configuration as the encoding apparatus 11 according to the first embodiment except for including a log envelope encoding unit 214 in place of the linear predictive analysis unit 112, the spectral envelope generating unit 113, and the log envelope generating unit 114 of the encoding apparatus 11 in the first embodiment. In the following, differences from the encoding apparatus 11 according to the first embodiment are described. Hereinafter, components common to the first embodiment are denoted with the same reference numerals as in the first embodiment and are not described in detail again.

[Log Envelope Encoding Unit 214]

To the log envelope encoding unit 214, the frequency spectral sequence $X_0, X_1, \ldots, X_{N-1}$ output by the frequency domain conversion unit 111 is input. The log envelope encoding unit 214 determines a log spectral envelope sequence $L_0, L_1, \ldots, L_{N-1}$ based on the frequency spectral values contained in the input frequency spectral sequence $X_0, X_1, \ldots, X_{N-1}$, and outputs the log spectral envelope sequence $L_0, L_1, \ldots, L_{N-1}$ to the signal smoothing unit 116 and outputs the envelope code CL, which is the code corresponding to the log spectral envelope sequence, to the multiplexing unit 117.

As a way of obtaining the log spectral envelope sequence $L_0, L_1, \ldots, L_{N-1}$ by the log envelope encoding unit 214, a way of performing vector quantization is illustrated. In a storage (not shown) within the log envelope encoding unit 214, for multiple candidates for a log spectral envelope sequence $L_0, L_1, \ldots, L_{N-1}$ formed by N integers such that their total sum is 0, sets which respectively include each candidate log spectral envelope sequence $L_0, L_1, \ldots, L_{N-1}$, a spectral envelope sequence $H_0, H_1, \ldots, H_{N-1}$, which is a sequence of powers of 2 with the exponent being each log spectral envelope value of that candidate log spectral envelope sequence $L_0, L_1, \ldots, L_{N-1}$, and a code corresponding to the candidate log spectral envelope sequence $L_0, L_1, \ldots, L_{N-1}$ are prestored. That is, the storage (not shown) in the log envelope encoding unit 214 has prestored therein multiple sets respectively including a candidate for the log spectral envelope sequence $L_0, L_1, \ldots, L_{N-1}$, a candidate for a spectral envelope sequence $H_0, H_1, \ldots, H_{N-1}$ corresponding to the candidate for the log spectral envelope sequence $L_0, L_1, \ldots, L_{N-1}$, and a code identifying the candidate for the log spectral envelope sequence $L_0, L_1, \ldots, L_{N-1}$. Among the multiple sets prestored in the storage, the log envelope encoding unit 214 selects a set corresponding to a spectral envelope sequence $H_0, H_1, \ldots, H_{N-1}$ for which the candidate for the spectral envelope sequence $H_0, H_1, \ldots, H_{N-1}$ corresponds to the input frequency spectral sequence $X_0, X_1, \ldots, X_{N-1}$ (the time series signal in the predetermined time segment), obtains the candidate for the log spectral envelope sequence $L_0, L_1, \ldots, L_{N-1}$ of the selected set as the log spectral envelope sequence $L_0, L_1, \ldots, L_{N-1}$, and obtains and outputs the code of the selected set as the envelope code CL (the code representing the spectral envelope). For example, for each spectral envelope sequence $H_0, H_1, \ldots, H_{N-1}$ stored in the storage, the log envelope encoding unit 214 determines the energy of a sequence of ratios between each frequency spectral value $X_k$ in the input frequency spectral sequence $X_0, X_1, \ldots, X_{N-1}$ and the corresponding spectral envelope value $H_k$ in the spectral envelope sequence $H_0, H_1, \ldots, H_{N-1}$, and outputs the log spectral envelope sequence $L_0, L_1, \ldots, L_{N-1}$ and the envelope code CL corresponding to the spectral envelope sequence $H_0, H_1, \ldots, H_{N-1}$ with the smallest energy.

[Multiplexing Unit 117]

The multiplexing unit 117 performs the same operations to those of the multiplexing unit 117 in the first embodiment except for using the envelope code CL output by the log envelope encoding unit 214 as the code representing the spectral envelope, in place of the linear predictive coefficient code Cα or the envelope code CL output by the linear predictive analysis unit 112 or the spectral envelope generating unit 113 in the first embodiment.

<<Decoding Apparatus 22>>

Figure 6B:
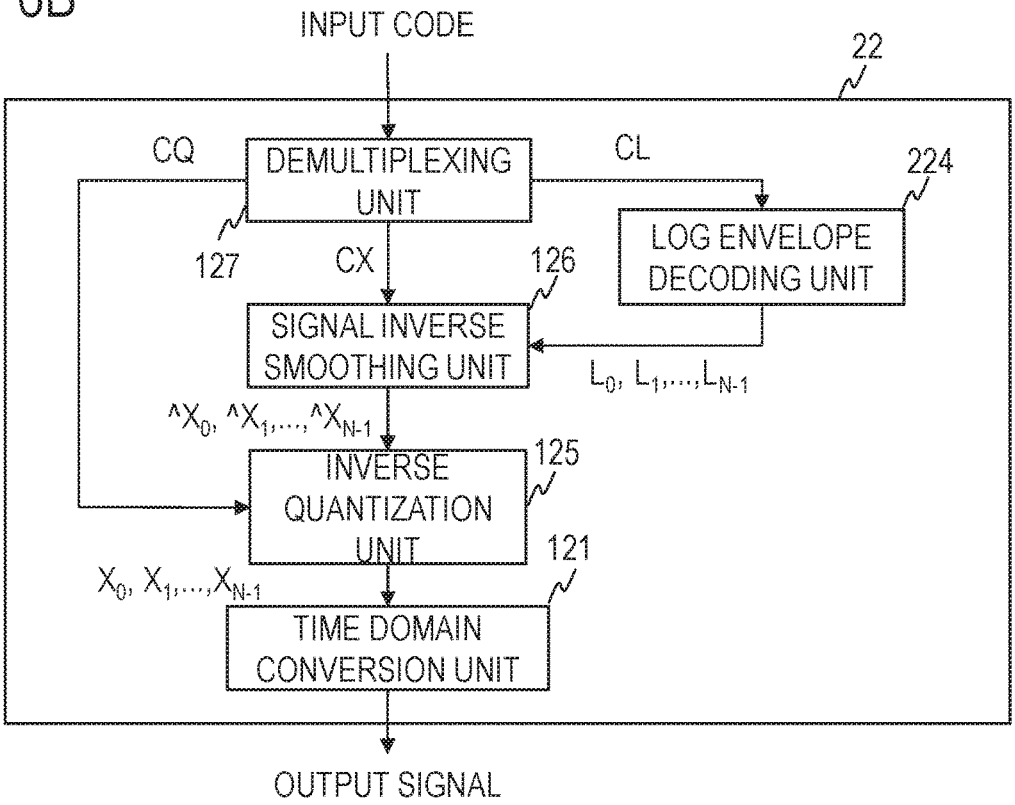
FIG. 6B is a functional configuration diagram of a decoding apparatus according to the second embodiment.

With reference to FIG. 6B, the functional configuration of a decoding apparatus 22 according to the second embodiment and the processing procedure of a decoding method performed by the decoding apparatus 22 are described. The decoding apparatus 22 according to the second embodiment has a same configuration to the decoding apparatus 12 according to the first embodiment except for including a log envelope decoding unit 224 in place of the spectral envelope generating unit 123 and the log envelope generating unit 124 of the decoding apparatus 12 in the first embodiment. In the following, differences from the decoding apparatus 12 according to the first embodiment are described.

[Demultiplexing Unit 127]

To the demultiplexing unit 127, the input code input to the decoding apparatus 22 is input. The demultiplexing unit 127 receives the input code on a per-frame basis, separates the input code, and outputs the envelope code CL, which is the code representing the spectral envelope, contained in the input code to the log envelope decoding unit 224, the quantization step size code CQ contained in the input code to the inverse quantization unit 125, and the signal code CX contained in the input code to the signal inverse smoothing unit 126, respectively.

[Log Envelope Decoding Unit 224]

In a storage (not shown) in the log envelope decoding unit 224, sets which respectively include each candidate log spectral envelope sequence $L_0, L_1, \ldots, L_{N-1}$ and a code corresponding to each sequence are prestored, for multiple candidates for a log spectral envelope sequence $L_0, L_1, \ldots, L_{N-1}$ formed by N integers such that their total sum is 0, which are the same as those stored in the storage (not shown) of the log envelope encoding unit 214 of the corresponding encoding apparatus 21. That is, the storage (not shown) in the log envelope decoding unit 224 has prestored therein multiple sets respectively including a candidate for the log spectral envelope sequence $L_0, L_1, \ldots, L_{N-1}$ and a code identifying the candidate for the log spectral envelope sequence $L_0, L_1, \ldots, L_{N-1}$. To the log envelope decoding unit 224, the envelope code CL output by the demultiplexing unit 127 is input. The log envelope decoding unit 224 retrieves the log spectral envelope sequence $L_0, L_1, \ldots, L_{N-1}$ corresponding to the input envelope code CL from the storage, and outputs it to the signal inverse smoothing unit 126. That is, among the multiple sets prestored in the storage, the log envelope decoding unit 224 selects a set whose code corresponds to the envelope code CL, obtains the candidate for the log spectral envelope sequence of the selected set as the log spectral envelope sequence $L_0, L_1, \ldots, L_{N-1}$, and outputs it to the signal inverse smoothing unit 126.

Third Embodiment

Figure 7A:
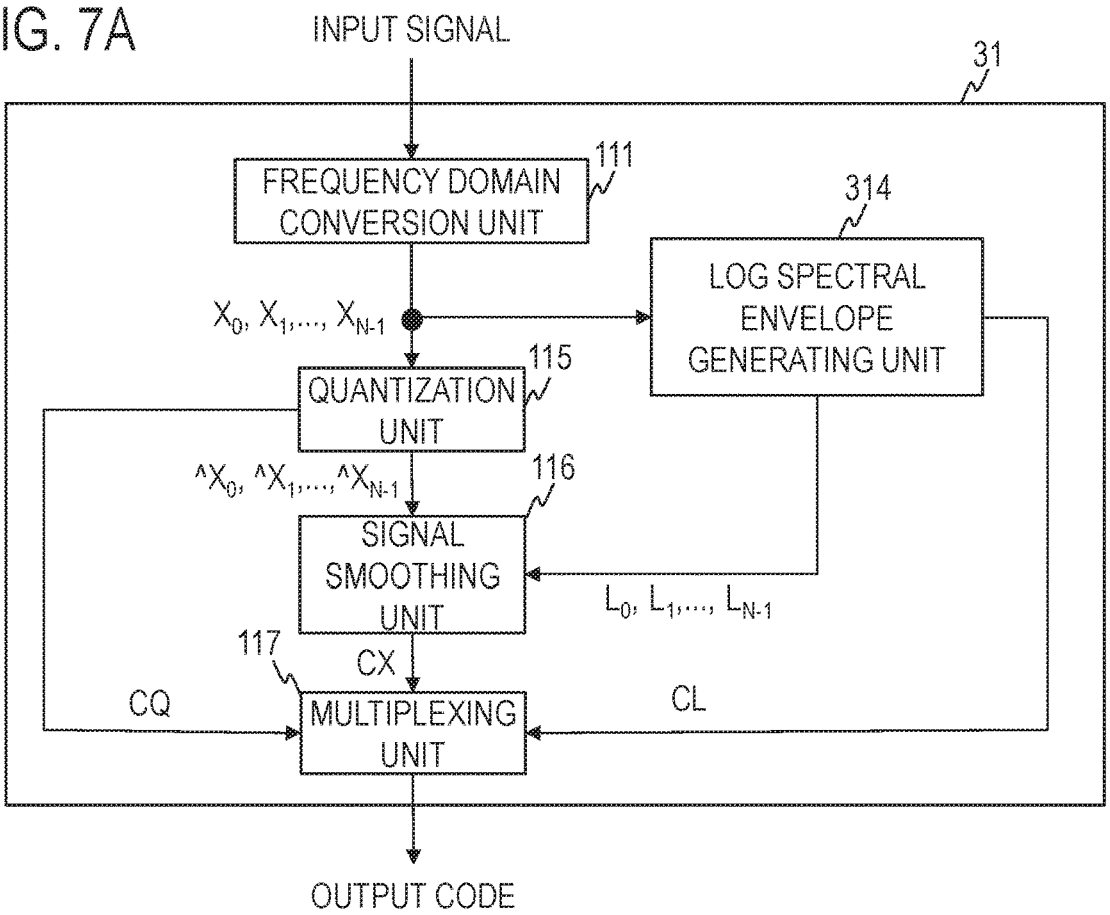
FIG. 7A is a functional configuration diagram of an encoding apparatus according to a third embodiment.

As described above, the encoding apparatus 11 according to the first embodiment and the encoding apparatus 21 according to the second embodiment both amount to an encoding apparatus 31 shown in FIG. 7A. The encoding apparatus 31 includes the frequency domain conversion unit 111, a log spectral envelope generating unit 314, the quantization unit 115, the signal smoothing unit 116, and the multiplexing unit 117. The log spectral envelope generating unit 314 obtains and outputs the log spectral envelope sequence $L_0, L_1, \ldots, L_{N-1}$ which is an integer value sequence corresponding to the binary logarithms of the respective sample values of the spectral envelope sequence corresponding to the time series signal in the predetermined time segment and is an integer value sequence whose total sum is 0, and the envelope code CL, which is a code identifying the log spectral envelope sequence. In the encoding apparatus 11 according to the first embodiment, a functional configuration including the linear predictive analysis unit 112 (envelope encoding unit), the spectral envelope generating unit 113, and the log envelope generating unit 114 corresponds to the log spectral envelope generating unit 314. In the encoding apparatus 21 according to the second embodiment, a functional configuration including the log envelope encoding unit 214 corresponds to the log spectral envelope generating unit 314. Also, the signal smoothing unit 116 obtains the smoothed spectral sequence $\sim X_0, \sim X_1, \ldots, \sim X_{N-1}$ by: with respect to a quantized spectral sequence $\hat{X}_0, \hat{X}_1, \ldots, \hat{X}_{N-1}$ obtained by quantization of the respective sample values of a frequency domain spectral sequence for a time series signal; for $\hat{X}_k$ (k is sample number, where $k \in \{0, \ldots, N-1\}$) with $L_k$ corresponding to $\hat{X}_k$ being a positive value, adopting $\hat{X}_k$ with $L_k$ digits from its least significant digit in binary removed as the smoothed spectral value $\sim X_k$; for $\hat{X}_k$ with $L_k$ corresponding to $\hat{X}_k$ being a negative value, adopting $\hat{X}_k$ with $-L_k$ digits added to its least significant digit in binary in accordance with a predefined rule as the smoothed spectral value $\sim X_k$; and when $L_k$ corresponding to $\hat{X}_k$ is 0, adopting $\hat{X}_k$ as the smoothed spectral value $\sim X_k$. The signal smoothing unit 116 then encodes the respective samples of the obtained smoothed spectral sequence $\sim X_0, \sim X_1, \ldots, \sim X_{N-1}$ with a fixed code length to obtain the signal code CX. The predefined rule is a rule defined based on an order of sample numbers and an order of digit numbers such that removed digits become digits to be added without excess or deficiency.

Figure 7B:
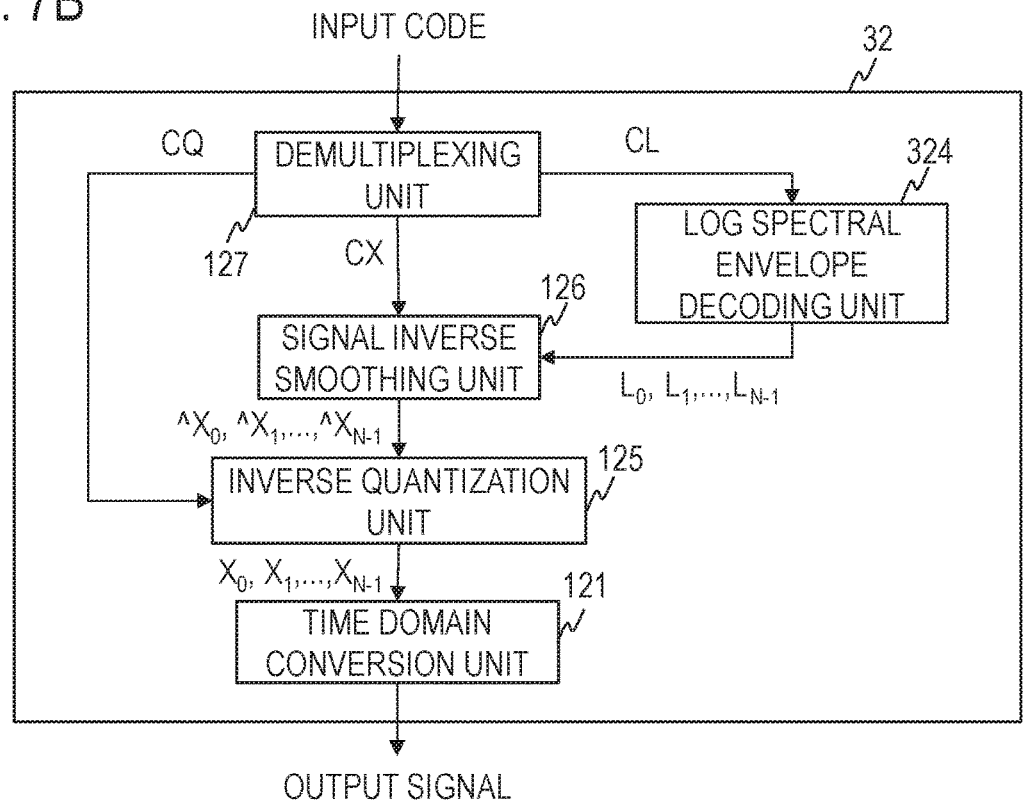
FIG. 7B is a functional configuration diagram of a decoding apparatus according to the third embodiment.

Similarly, the decoding apparatus 12 according to the first embodiment and the decoding apparatus 22 according to the second embodiment both correspond to a decoding apparatus 32 shown in FIG. 7B. The decoding apparatus 32 includes the time domain conversion unit 121, a log spectral envelope decoding unit 324, the inverse quantization unit 125, the signal inverse smoothing unit 126, and the demultiplexing unit 127. The log spectral envelope decoding unit 324 decodes the input envelope code CL and obtains the log spectral envelope sequence $L_0, L_1, \ldots, L_{N-1}$, which is an integer value sequence corresponding to the binary logarithms of the respective sample values of the spectral envelope sequence and is an integer value sequence whose total sum is 0. In the decoding apparatus 12 according to the first embodiment, a functional configuration including the spectral envelope generating unit 123 and the log envelope generating unit 124 corresponds to the log spectral envelope decoding unit 324. In the decoding apparatus 22 according to the second embodiment, a functional configuration including the log envelope decoding unit 224 corresponds to the log spectral envelope decoding unit 324. The signal inverse smoothing unit 126 decodes the signal code CX which is a fixed-length code to obtain the smoothed spectral sequence $\sim X_0, \sim X_1, \ldots, \sim X_{N-1}$ for the predetermined time segment, and then for the smoothed spectral sequence $\sim X_0, \sim X_1, \ldots, \sim X_{N-1}$, obtains the quantized spectral sequence $\hat{X}_0, \hat{X}_1, \ldots, \hat{X}_N$, which is a sequence of quantized spectra for the predetermined time segment by: for $\sim X_k$ (k is sample number, where $k \in \{0, \ldots, N-1\}$) with $L_k$ corresponding to $\sim X_k$ being a negative value, adopting $\sim X_k$ with $-L_k$ digits from its least significant digit in binary removed as the quantized spectral value $\hat{X}_k$; for $\sim X_k$ with $L_k$ corresponding to $\sim X_k$ being a positive value, adopting $\sim X_k$ with $L_k$ digits added to its least significant digit in binary in accordance with a predefined rule as the quantized spectral value $\hat{X}_k$; and when $L_k$ corresponding to $\sim X_k$ is 0, adopting $\sim X_k$ as the quantized spectral value $\hat{X}_k$. The predefined rule is a rule defined based on an order of sample numbers and an order of digit numbers such that removed digits become digits to be added without excess or deficiency. The inverse quantization unit 125 inverse-quantizes the quantized spectral sequence $\hat{X}_0, \hat{X}_1, \ldots, \hat{X}_{N-1}$ to obtain the frequency domain spectral sequence $X_0, X_1, \ldots, X_{N-1}$, and outputs it. That is, the inverse quantization unit 125 inverse-quantizes the quantized spectral sequence $\hat{X}_0, \hat{X}_1, \ldots, \hat{X}_{N-1}$ to obtain the frequency domain spectral sequence $X_0, X_1, \ldots, X_{N-1}$, which is a sequence of decoded frequency domain spectra for the predetermined time segment. The time domain conversion unit 121 converts the frequency domain spectral sequence $X_0, X_1, \ldots, X_{N-1}$ to the time domain to obtain an output signal, which is a decoded time series signal for the predetermined time segment, and outputs it.

Fourth Embodiment

Figure 8A:
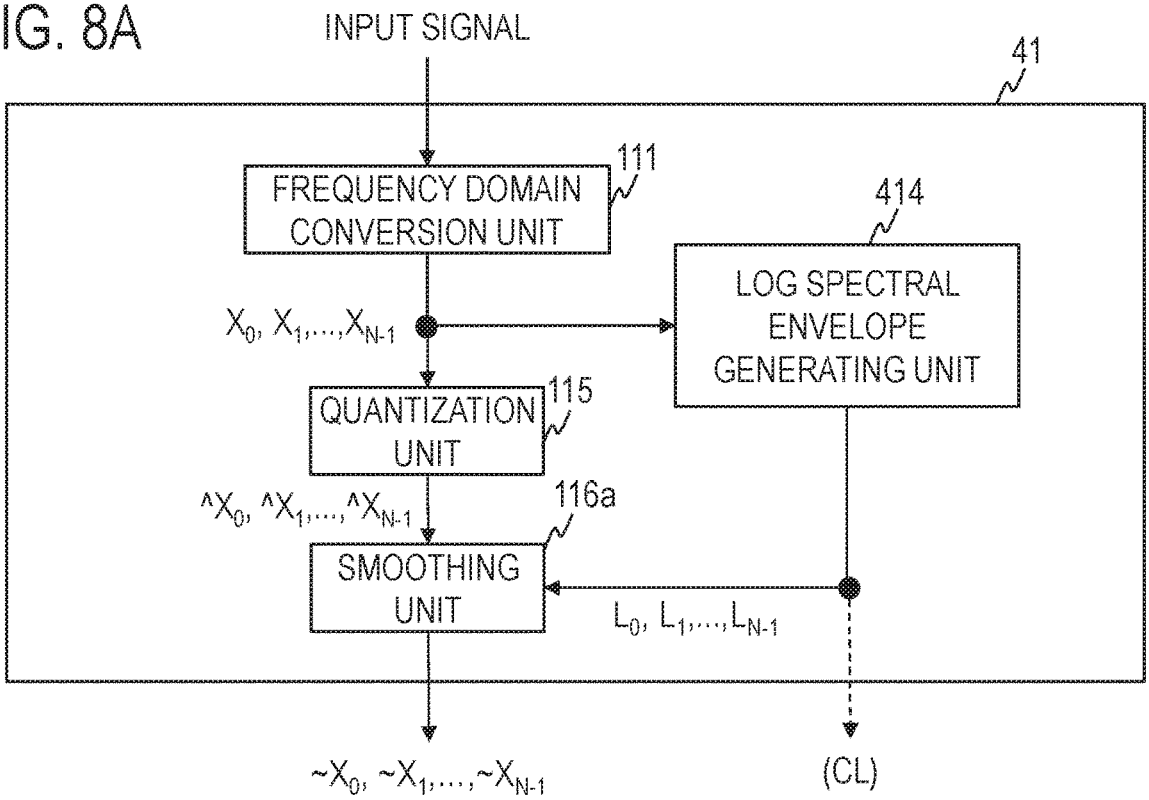
FIG. 8A is a functional configuration diagram of a smoothing apparatus according to a fourth embodiment.

As illustrated in FIG. 8A, a smoothing apparatus 41 may be configured which takes as input an input signal which is a time series signal such as an audio signal, and outputs the smoothed spectral sequence $\sim X_0, \sim X_1, \ldots, \sim X_{N-1}$ which is obtained by the smoothing unit 116*a* of the signal smoothing unit 116 of the encoding apparatus 11 according to the first embodiment, the encoding apparatus 21 according to the second embodiment, or the encoding apparatus 31 according to the third embodiment. The smoothing apparatus 41 includes the frequency domain conversion unit 111, a log spectral envelope generating unit 414, the quantization unit 115, and the smoothing unit 116*a*. The log spectral envelope generating unit 414 obtains and outputs the log spectral envelope sequence $L_0, L_1, \ldots, L_{N-1}$, which is an integer value sequence corresponding to the binary logarithms of the respective sample values of the spectral envelope sequence corresponding to the time series signal in the predetermined time segment and is an integer value sequence whose total sum is 0. The log spectral envelope generating unit 414 may be of the same configuration as the log spectral envelope generating unit 314 in the third embodiment or may be of a configuration that excludes the functional configuration for obtaining and outputting the envelope code CL from the functional configuration of the log spectral envelope generating unit 314. The smoothing unit 116*a* obtains and outputs the smoothed spectral sequence $\sim X_0, \sim X_1, \ldots, \sim X_{N-1}$ by: with respect to the quantized spectral sequence $\hat{X}_0, \hat{X}_1, \ldots, \hat{X}_{N-1}$ obtained by quantization of the respective sample values of the frequency domain spectral sequence for a time series signal; for $\hat{X}_k$ (k is sample number, where $k \in \{0, \ldots, N-1\}$) with $L_k$ corresponding to $\hat{X}_k$ being a positive value, adopting $\hat{X}_k$ with $L_1$, digits from its least significant digit in binary removed as the smoothed spectral value $\sim X_k$; for $\hat{X}_k$ with $L_k$ corresponding to $\hat{X}_k$ being a negative value, adopting $\hat{X}_k$ with $-L_k$ digits added to its least significant digit in binary in accordance with a predefined rule as the smoothed spectral value $\sim X_k$; and when $L_k$ corresponding to $\hat{X}_k$ is 0, adopting $\hat{X}_k$ as the smoothed spectral value $\sim X_k$. The predefined rule is a rule defined based on an order of sample numbers and an order of digit numbers such that removed digits become digits to be added without excess or deficiency. If the log spectral envelope generating unit 414 outputs the envelope code CL, the smoothing apparatus 41 may output the envelope code CL.

Figure 8B:
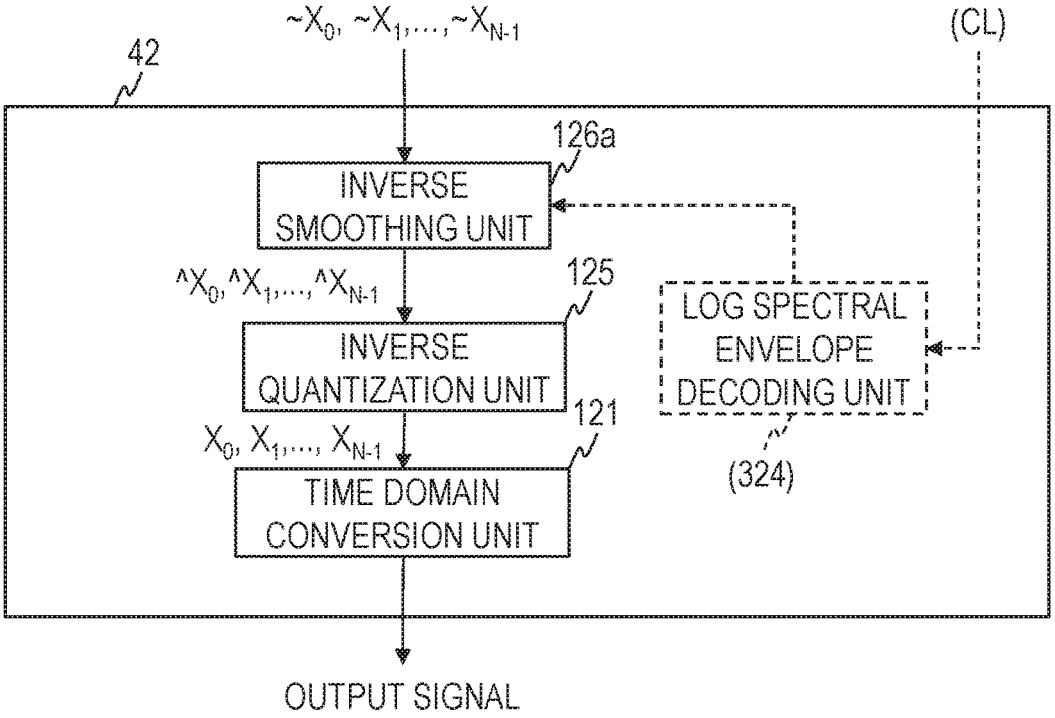
FIG. 8B is a functional configuration diagram of an inverse smoothing apparatus according to the fourth embodiment.
Figure 9A:
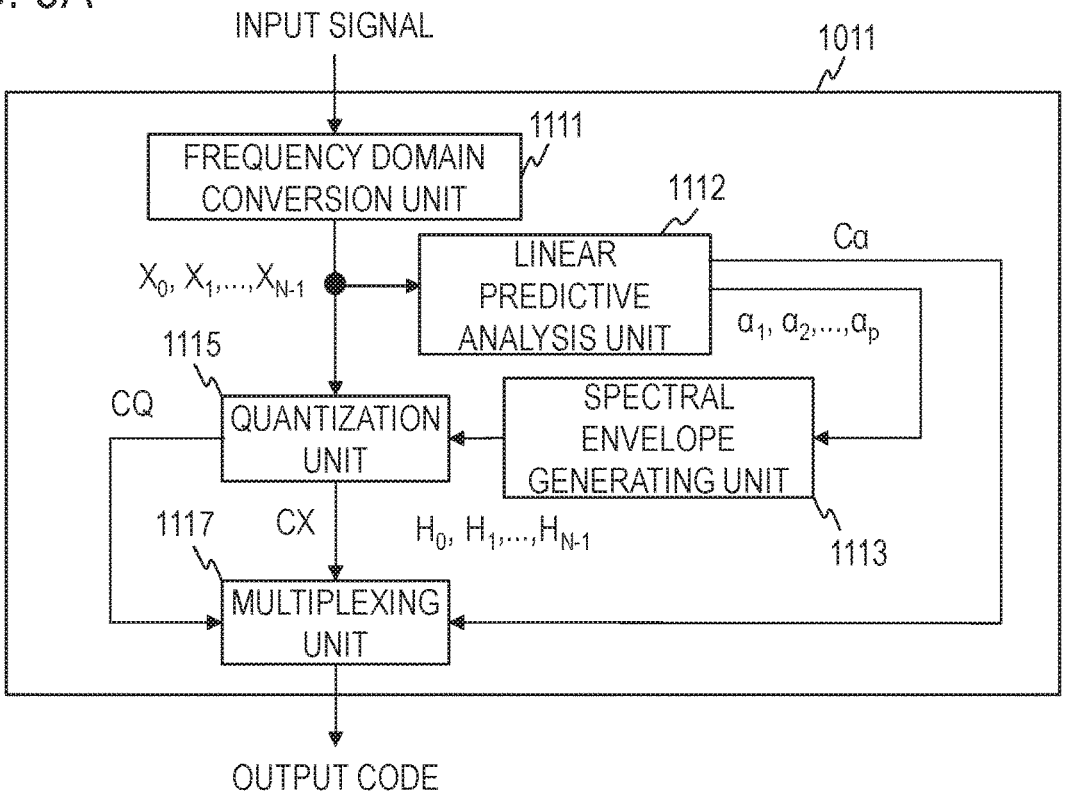
FIG. 9A is a functional configuration diagram of an encoding apparatus according to Non-patent Literature 1.
Figure 9B:
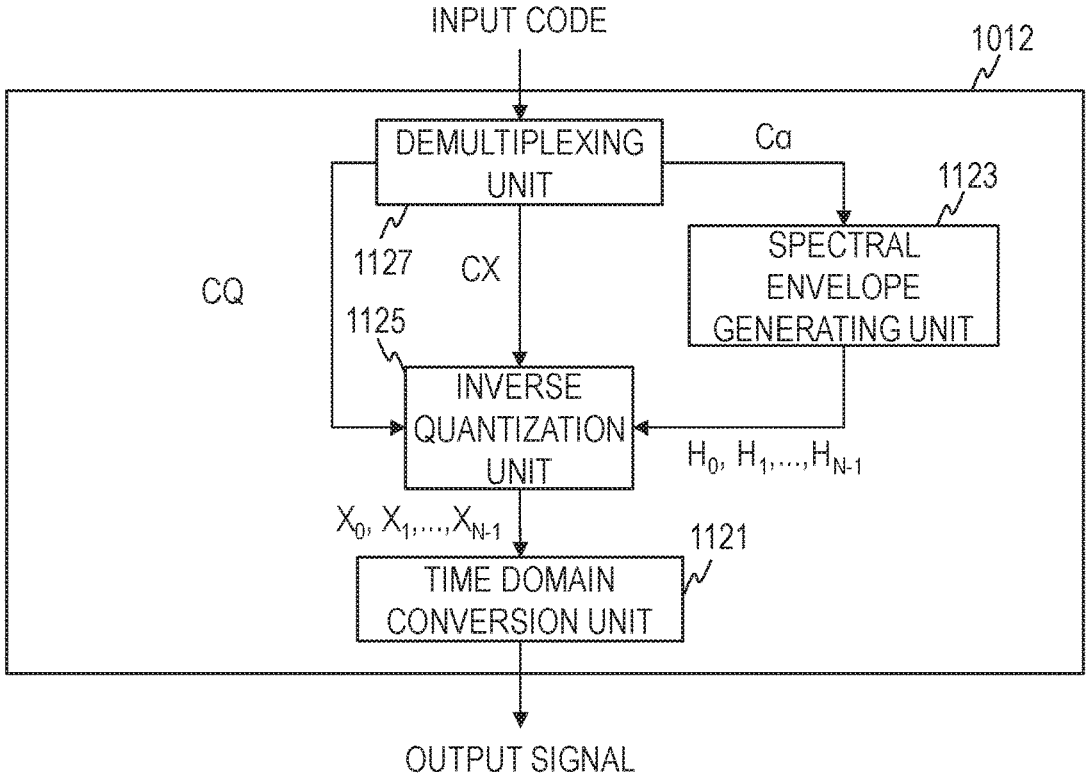
FIG. 9B is a functional configuration diagram of a decoding apparatus according to Non-patent Literature 1.

As illustrated in FIG. 8B, an inverse smoothing apparatus 42 that takes as input the smoothed spectral sequence $\sim X_0, \sim X_1, \ldots, \sim X_{N-1}$ output by the smoothing apparatus 41 and performs inverse smoothing of the smoothed spectral sequence $\sim X_0, \sim X_1, \ldots, \sim X_{N-1}$ may be configured. The inverse smoothing apparatus 42 includes the inverse smoothing unit 126*a*, the inverse quantization unit 125, and the time domain conversion unit 121. The inverse smoothing apparatus 42, to which the envelope code CL output by the smoothing apparatus 41 is input, further includes the log spectral envelope decoding unit 324 mentioned earlier. In a case where the inverse smoothing apparatus 42 is able to obtain the log spectral envelope sequence $L_0, L_1, \ldots, L_{N-1}$ and the smoothed spectral sequence $\sim X_0, \sim X_1, \ldots, \sim X_{N-1}$ is output by the smoothing apparatus 41, this smoothed spectral sequence $\sim X_0, \sim X_1, \ldots, \sim X_{N-1}$ is input to the inverse smoothing unit 126*a*. In a case where the smoothed spectral sequence $\sim X_0, \sim X_1, \ldots, \sim X_{N-1}$ and the envelope code CL are output by the smoothing apparatus 41, the smoothed spectral sequence $\sim X_0, \sim X_1, \ldots, \sim X_{N-1}$ is input to the inverse smoothing unit 126*a* and the envelope code CL is input to the log spectral envelope decoding unit 324. Upon input of the envelope code CL, the log spectral envelope decoding unit 324 decodes the envelope code CL to obtain the log spectral envelope sequence $L_0, L_1, \ldots, L_{N-1}$ as described above, and inputs the log spectral envelope sequence $L_0, L_1, \ldots, L_{N-1}$ to the inverse smoothing unit 126*a*. The inverse smoothing unit 126*a* takes as input the smoothed spectral sequence $\sim X_0, \sim X_1, \ldots, \sim X_{N-1}$ and the log spectral envelope sequence $L_0, L_1, \ldots, L_{N-1}$ and uses the log spectral envelope sequence $L_0, L_1, \ldots, L_{N-1}$ to perform the inverse smoothing of the smoothed spectral sequence $\sim X_0, \sim X_1, \ldots, \sim X_{N-1}$ as described above, and obtains and outputs the quantized spectral sequence $\hat{X}_0, \hat{X}_1, \ldots, \hat{X}_{N-1}$. That is, the inverse smoothing unit 126*a* takes as input the log spectral envelope sequence $L_0, L_1, \ldots, L_{N-1}$ which is an integer value sequence corresponding to binary logarithms of respective sample values of a spectral envelope sequence for the predetermined time segment and is an integer value sequence whose total sum is 0, and a smoothed spectral sequence $\sim X_0, \sim X_1, \ldots, \sim X_{N-1}$ for the predetermined time segment, and then for the smoothed spectral sequence $\sim X_0, \sim X_1, \ldots, \sim X_{N-1}$, obtains and outputs a quantized spectral sequence $\hat{X}_0, \hat{X}_1, \ldots, \hat{X}_{N-1}$, which is a sequence of quantized spectra for the predetermined time segment by: for $\sim X_k$ (k is sample number, where $k \in \{0, \ldots, N-1\}$) with $L_k$ corresponding to $\sim X_k$ being a negative value, adopting $\sim X_k$ with $-L_k$ digits from its least significant digit in binary removed as a quantized spectral value $\hat{X}_k$; for $\sim X_k$ with $L_k$ corresponding to $\sim X_k$ being a positive value, adopting $\sim X_k$ with $L_k$ digits added to its least significant digit in binary in accordance with a predefined rule as the quantized spectral value $\hat{X}_k$; and when $L_k$ corresponding to $\sim X_k$ is 0, adopting $\sim X_k$ as the quantized spectral value $\hat{X}_k$. The predefined rule is a rule defined based on an order of sample numbers and an order of digit numbers such that removed digits become digits to be added without excess or deficiency. The inverse quantization unit 125 inverse-quantizes the quantized spectral sequence $\hat{X}_0, \hat{X}_1, \ldots, \hat{X}_{N-1}$ to obtain the frequency domain spectral sequence $X_0, X_1, \ldots, X_{N-1}$ and outputs it. That is, the inverse quantization unit 125 inverse-quantizes the quantized spectral sequence $\hat{X}_0, \hat{X}_1, \ldots, \hat{X}_{N-1}$ to obtain the frequency domain spectral sequence $X_0, X_1, \ldots, X_{N-1}$, which is a sequence of decoded frequency domain spectra for the predetermined time segment. The time domain conversion unit 121 converts the frequency domain spectral sequence $X_0, X_1, \ldots, X_{N-1}$ to the time domain to obtain an output signal, which is a decoded time series signal for the predetermined time segment, and outputs it.

MODIFICATIONS AND OTHERS

The present invention is not limited to the foregoing embodiments. For example, although the smoothed sequence encoding unit 116*b* of the signal smoothing unit 116 of the encoding apparatus 11, 21, 31 in the respective embodiments obtains the signal code CX by encoding, with a fixed code length, the respective samples of a smoothed spectral sequence obtained by smoothing, it may be configured to obtain the signal code CX by variable length encoding. In that case, the smoothed sequence decoding unit 126*b* of the signal inverse smoothing unit 126 of the decoding apparatus 12, 22, 32 may obtain the smoothed spectral sequence by the variable length decoding of the signal code CX. In this modification, if an error is present in the signal code CX contained in the input code to the decoding apparatus, an error may affect smoothed spectral values other than those to which bits with errors in the signal code CX correspond; however, no error occurs in the number of samples in the quantized spectral sequence even if much error occurs in the envelope code CL contained in the input code to the decoding apparatus 12, 22, 32 just as in the embodiments described above.

In the above embodiments, the audio signal (time series signal) input to the encoding apparatus 11, 21, 31 and the smoothing apparatus 41 was illustrated as being a digital signal generated by picking up sound, such as speech or music, with a microphone and subjecting the resulting analog signal representing the sound to analog-to-digital conversion. However, this is merely exemplary and is not intended to limit the present invention. For example, an audio signal generated by analog-to-digital conversion of an otherwise acquired analog signal representing sound to a digital signal may be input to the encoding apparatus 11, 21, 31 or the smoothing apparatus 41. An audio signal which is a digital signal corresponding to an analog signal representing sound may be input to the encoding apparatus 11, 21, 31 or the smoothing apparatus 41. An audio signal which is a digital signal representing sound may be input to the encoding apparatus 11, 21, 31 or the smoothing apparatus 41. That is, the way of obtaining an audio signal is optional. An analog signal representing sound may be input to the encoding apparatus 11, 21, 31 or the smoothing apparatus 41. In that case, a digital signal obtained by analog-to-digital conversion of the analog signal in the encoding apparatus 11, 21, 31 or the smoothing apparatus 41 may be used as the audio signal. That is, input of digital signals to the encoding apparatus 11, 21, 31 or the smoothing apparatus 41 is also optional.

In the above embodiments, an audio signal in the time domain is input to the encoding apparatus 11, 21, 31 or the smoothing apparatus 41, and the audio signal in the time domain is converted to the frequency spectral sequence $X_0, X_1, \ldots, X_{N-1}$. However, this is merely exemplary and is not intended to limit the present invention. For example, the frequency spectral sequence $X_0, X_1, \ldots, X_{N-1}$ may be input to the encoding apparatus 11, 21, 31 or the smoothing apparatus 41. In that case, the encoding apparatus 11, 21, 31 or the smoothing apparatus 41 may not include the frequency domain conversion unit 111. That is, the frequency domain conversion unit 111 is an optional element for the encoding apparatus 11, 21, 31 or the smoothing apparatus 41.

In the above embodiments, the decoding apparatus 12, 22, 32 or the inverse smoothing apparatus 42 converts the decoded spectral sequence $X_0, X_1, \ldots, X_{N-1}$ to a signal in the time domain to obtain an audio signal in units of frame, and outputs it as the output signal. However, this is merely exemplary and is not intended to limit the present invention. For example, the decoding apparatus 12, 22, 32 or the inverse smoothing apparatus 42 may output the decoded spectral sequence $X_0, X_1, \ldots, X_{N-1}$ as the output signal. In that case, the decoding apparatus 12, 22, 32 or the inverse smoothing apparatus 42 may not include the time domain conversion unit 121. That is, the time domain conversion unit 121 is an optional element for the decoding apparatus 12, 22, 32 or the inverse smoothing apparatus 42. The decoding apparatus 12, 22, 32 or the inverse smoothing apparatus 42 may output a function value of the decoded spectral sequence $X_0, X_1, \ldots, X_{N-1}$ as the output signal. The output signal output by the decoding apparatus 12, 22, 32 or the inverse smoothing apparatus 42 may be used as an input signal for other processing without being reproduced from a speaker. That is, reproduction of the output signal output by the decoding apparatus 12, 22, 32 or the inverse smoothing apparatus 42 from a speaker is also optional.

The smoothing unit 116*a* of the signal smoothing unit 116 or the smoothing unit 116*a* of the smoothing apparatus 41 preferably adopts $\hat{X}_k$ with $L_k$ digits from its least significant digit in binary removed as the smoothed spectral value $\sim X_k$ for all $\hat{X}_k$ with $L_k$ corresponding to $\hat{X}_k$ being a positive value, and adopts $\hat{X}_k$ with $-L_k$ digits added to its least significant digit in binary in accordance with a predefined rule as the smoothed spectral value $\sim X_k$ for all $\hat{X}_k$ with $L_k$ corresponding to $\hat{X}_k$ being a negative value. However, the smoothing unit 116*a* of the signal smoothing unit 116 or the smoothing unit 116*a* of the smoothing apparatus 41 may also adopt $\hat{X}_k$ directly as the smoothed spectral value $\sim X_k$ without removing of $L_k$ digits from the least significant digit of $\hat{X}_k$ in binary for some $\hat{X}_k$ with $L_k$ corresponding to $\hat{X}_k$ being a positive value, and adopt $\hat{X}_k$ directly as the smoothed spectral value $\sim X_k$ without adding $-L_k$ digits to the least significant digit of $\hat{X}_k$ in binary in accordance with a predefined rule for some $\hat{X}_k$ with $L_k$ corresponding to $\hat{X}_k$ being a negative value. Similarly, the inverse smoothing unit 126*a* of the signal inverse smoothing unit 126 or the inverse smoothing unit 126*a* of the inverse smoothing apparatus 42 preferably adopts $\sim X_k$ with $-L_k$ digits from its least significant digit in binary removed as the quantized spectral value $\hat{X}_k$ for all $\sim X_k$ with $L_k$ corresponding to $\sim X_k$ being a negative value, and adopts $\sim X_k$ with $L_k$ digits added to its least significant digit in binary in accordance with a predefined rule as the quantized spectral value $\hat{X}_k$ for all $\sim X_k$ with $L_k$ corresponding to $\sim X_k$ being a positive value. However, the inverse smoothing unit 126*a* of the signal inverse smoothing unit 126 or the inverse smoothing unit 126*a* of the inverse smoothing apparatus 42 may also adopt $\sim X_k$ directly as the quantized spectral value $\hat{X}_k$ without removing $-L_k$ digits from the least significant digit of $\sim X_k$ in binary for some $\sim X_k$ with $L_k$ corresponding to $\sim X_k$ being a negative value, and adopt $\sim X_k$ directly as the quantized spectral value $\hat{X}_k$ without adding $L_k$ digits to the least significant digit of $\sim X_k$ in binary in accordance with a predefined rule for some $\sim X_k$ with $L_k$ corresponding to $\sim X_k$ being a positive value.

The time series signal may be a time series signal other than an audio signal (for example, video signal, seismic wave signal, biological signal, or the like). That is, the time series signal being an audio signal is also optional.

The above-described various kinds of processing may be executed, in addition to being executed in chronological order in accordance with the descriptions, in parallel or individually depending on the processing power of an apparatus that executes the processing or when needed. In addition, it goes without saying that changes may be made as appropriate without departing from the spirit of the present invention.

The above-described each apparatus is embodied by execution of a predetermined program by a general- or special-purpose computer having a processor (hardware processor) such as a central processing unit (CPU), memories such as random-access memory (RAM) and read-only memory (ROM), and the like, for example. The computer may have one processor and one memory or have multiple processors and memories. The program may be installed on the computer or pre-recorded on the ROM and the like. Also, some or all of the processing units may be embodied using an electronic circuit that implements processing functions without using programs, rather than an electronic circuit (circuitry) that implements functional components by loading of programs like a CPU. An electronic circuit constituting a single apparatus may include multiple CPUs.

When the above-described configurations are implemented by a computer, the processing details of the functions supposed to be provided in each apparatus are described by a program. As a result of this program being executed by the computer, the above-described processing functions are implemented on the computer. The program describing the processing details can be recorded on a computer-readable recording medium. An example of the computer-readable recording medium is a non-transitory recording medium. Examples of such a recording medium include a magnetic recording device, an optical disk, a magneto-optical recording medium, and semiconductor memory.

The distribution of this program is performed by, for example, selling, transferring, or lending a portable recording medium such as a DVD or a CD-ROM on which the program is recorded. Furthermore, a configuration may be adopted in which this program is distributed by storing the program in a storage device of a server computer and transferring the program to other computers from the server computer via a network.

The computer that executes such a program first, for example, temporarily stores the program recorded on the portable recording medium or the program transferred from the server computer in a storage device thereof. At the time of execution of processing, the computer reads the program stored in the storage device thereof and executes the processing in accordance with the read program. As another mode of execution of this program, the computer may read the program directly from the portable recording medium and execute the processing in accordance with the program and, furthermore, every time the program is transferred to the computer from the server computer, the computer may sequentially execute the processing in accordance with the received program. A configuration may be adopted in which the transfer of a program to the computer from the server computer is not performed and the above-described processing is executed by so-called application service provider (ASP)-type service by which the processing functions are implemented only by an instruction for execution thereof and result acquisition.

Instead of executing a predetermined program on the computer to implement the processing functions of the present apparatuses, at least some of the processing functions may be implemented by hardware.

DESCRIPTION OF REFERENCE NUMERALS

11, 21, 31, 1011 encoding apparatus
12, 22, 32, 1012 decoding apparatus
41 smoothing apparatus
42 inverse smoothing apparatus

What is claimed is:

1. An encoding apparatus comprising: 'processing circuitry configured to implement:

a log spectral envelope generating unit configured to obtain a log spectral envelope sequence $L_0, L_1, \ldots, L_{N-1}$, which is an integer value sequence corresponding to binary logarithms of respective sample values of a spectral envelope sequence corresponding to a time series signal in a predetermined time segment and is an integer value sequence whose total sum is 0, and an envelope code which is a code identifying the log spectral envelope sequence; and a signal smoothing unit configured to obtain a smoothed spectral sequence $\sim X_0, \sim X_1, \ldots, \sim X_{N-1}$ by:

with respect to a quantized spectral sequence $\hat{X}_0, \hat{X}_1, \ldots, \hat{X}_{N-1}$ obtained by quantization of respective sample values of a frequency domain spectral sequence for the time series signal, for $\hat{X}_k$ (k is sample number, where $k \in \{0, \ldots, N-1\}$) with $L_k$ corresponding to $\hat{X}_k$ being a positive value, adopting $\hat{X}_k$ with $L_1$ digits from its least significant digit in binary removed as the smoothed spectral value $\sim X_k$;

for $\hat{X}_k$ with $L_k$ corresponding to $\hat{X}_k$ being a negative value, adopting $\hat{X}_k$ with $-L_k$ digits added to its least significant digit in binary in accordance with a predefined rule as $\sim X_k$; and when $L_k$ corresponding to $\hat{X}_k$ is 0, adopting $\hat{X}_k$ as asmoothed spectral value $\sim X_k$, and to encode respective samples of the obtained smoothed spectral sequence $\sim X_0, \sim X_1, \ldots, \sim X_{N-1}$ with a fixed code length to obtain a signal code, wherein the predefined rule is a rule defined based on an order of sample numbers and an order of digit numbers such that removed digits become digits to be added without excess or deficiency.

2. The encoding apparatus according to claim 1, wherein the log spectral envelope generating unit includes a log envelope encoding unit, the log envelope encoding unit has prestored therein a plurality of sets which respectively include a candidate for the log spectral envelope sequence, a candidate for a spectral envelope sequence corresponding to the candidate for the log spectral envelope sequence, and a code identifying the candidate for the log spectral envelope sequence, and the log envelope encoding unit selects, among the plurality of sets prestored therein, a set corresponding to a spectral envelope sequence for which a candidate for the spectral envelope sequence corresponds to the time series signal in the predetermined time segment, obtains the candidate for the log spectral envelope sequence of the selected set as the log spectral envelope sequence, and obtains the code of the selected set as the envelope code.

3. The encoding apparatus according to claim 1, wherein the log spectral envelope generating unit is configured to obtain the spectral envelope sequence corresponding to the time series signal and an envelope code corresponding to the spectral envelope sequence, obtain an integer value sequence corresponding to binary logarithms of respective sample values of the spectral envelope sequence, when a total sum of values contained in the integer value sequence is 0, adopt the integer value sequence as the log spectral envelope sequence, and when the total sum of the values contained in the integer value sequence is not 0, adjust at least some of integer values contained in the integer value sequence in accordance with a predefined rule so that the total sum of the values contained in the integer value sequence after adjustment becomes 0, and obtain the integer value sequence after adjustment as the log spectral envelope sequence.

4. A decoding apparatus comprising:

processing circuitry configured to implement:

a log spectral envelope decoding unit configured to decode an input envelope code to obtain a log spectral envelope sequence $L_0, L_1, \ldots, L_{N-1}$, which is an integer value sequence corresponding to binary logarithms of respective sample values of a spectral envelope sequence for a predetermined time segment and is an integer value sequence whose total sum is 0; and a signal inverse smoothing unit configured to decode a signal code which is a fixed-length code to obtain a smoothed spectral sequence $\sim X_0, \sim X_1, \ldots, \sim X_{N-1}$ for the predetermined time segment, and for the smoothed spectral sequence $\sim X_0, \sim X_1, \ldots, \sim X_{N-1}$, obtain a quantized spectral sequence $\hat{X}_0, \hat{X}_1, \ldots, \hat{X}_{N-1}$ which is a sequence of quantized spectra for the predetermined time segment by:

for $\sim X_k$ (k is sample number, where $k \in \{0, \ldots, N-1\}$) with $L_k$ corresponding to $\sim X_k$ being a negative value, adopting $\sim X_k$ with $-L_k$ digits from its least significant digit in binary removed as a quantized spectral value $\hat{X}_k$;

for $\sim X_k$ with $L_k$ corresponding to $\sim X_k$ being a positive value, adopting $\sim X_k$ with $L_k$ digits added to its least significant digit in binary in accordance with a predefined rule as a quantized spectral value $\hat{X}_k$; and when $L_k$ corresponding to $\sim X_k$ is 0, adopting $\sim X_k$ as a quantized spectral value $\hat{X}_k$, wherein the predefined rule is a rule defined based on an order of sample numbers and an order of digit numbers such that removed digits become digits to be added without excess or deficiency.

5. The decoding apparatus according to claim 4, wherein the log spectral envelope decoding unit includes a log envelope decoding unit, the log envelope decoding unit has prestored therein a plurality of sets which respectively include a candidate for the log spectral envelope sequence and a code identifying the candidate for the log spectral envelope sequence, and the log envelope decoding unit selects, among the plurality of sets prestored therein, a set whose code corresponds to the envelope code, and obtains the candidate for the log spectral envelope sequence of the selected set as the log spectral envelope sequence $L_0, L_1, \ldots, L_{N-1}$.

6. The decoding apparatus according to claim 4, wherein the log spectral envelope decoding unit includes a spectral envelope generating unit configured to decode the envelope code to obtain the spectral envelope sequence, and a log envelope generating unit configured to obtain an integer value sequence corresponding to binary logarithms of respective sample values of the spectral envelope sequence, when a total sum of values contained in the integer value sequence is 0, adopt the integer value sequence as the log spectral envelope sequence, and when the total sum of the values contained in the integer value sequence is not 0, adjust at least some of integer values contained in the integer value sequence in accordance with a predefined rule so that the total sum of the values contained in the integer value sequence after adjustment becomes 0, and obtain the integer value sequence after adjustment as the log spectral envelope sequence.

7. A smoothing apparatus comprising:

processing circuitry configured to implement:

a log spectral envelope generating unit configured to obtain a log spectral envelope sequence $L_0, L_1, \ldots, L_{N-1}$, which is an integer value sequence corresponding to binary logarithms of respective sample values of a spectral envelope sequence corresponding to a time series signal in a predetermined time segment and is an integer value sequence whose total sum is 0; and a smoothing unit configured to obtain a smoothed spectral sequence $\sim X_0, \sim X_1, \ldots, \sim X_{N-1}$ by:

with respect to a quantized spectral sequence $\hat{X}_0, \hat{X}_1, \ldots, \hat{X}_{N-1}$ obtained by quantization of respective sample values of a frequency domain spectral sequence for the time series signal, for $\hat{X}_k$ (k is sample number, where $k \in \{0, \ldots, N-1\}$) with $L_k$ corresponding to $\hat{X}_k$ being a positive value, adopting $\hat{X}_k$ with $L_1$ digits from its least significant digit in binary removed as the smoothed spectral value $\sim X_k$;

for $\hat{X}_k$ with $L_k$ corresponding to $\hat{X}_k$ being a negative value, adopting $\hat{X}_k$ with $-L_k$ digits added to its least significant digit in binary in accordance with a predefined rule as $\sim X_k$; and when $L_k$ corresponding to $\hat{X}_k$ is 0, adopting $\hat{X}_k$ as a smoothed spectral value $\sim X_k$, wherein the predefined rule is a rule defined based on an order of sample numbers and an order of digit numbers such that removed digits become digits to be added without excess or deficiency.

8. An inverse smoothing apparatus comprising:

processing circuitry configured to implement:

an inverse smoothing unit, the inverse smoothing unit being configured to take as input a log spectral envelope sequence $L_0, L_1, \ldots, L_{N-1}$, which is an integer value sequence corresponding to binary logarithms of respective sample values of a spectral envelope sequence for a predetermined time segment and is an integer value sequence whose total sum is 0, and a smoothed spectral sequence $\sim X_0, \sim X_1, \ldots, \sim X_{N-1}$ for the predetermined time segment, and for the smoothed spectral sequence $\sim X_0, \sim X_1, \ldots, \sim X_{N-1}$, obtain a quantized spectral sequence $\hat{X}_0, \hat{X}_1, \ldots, \hat{X}_{N-1}$ which is a sequence of quantized spectra for the predetermined time segment by:

for $\sim X_k$ (k is sample number, where $k \in \{0, \ldots, N-1\}$) with $L_k$ corresponding to $\sim X_k$ being a negative value, adopting $\sim X_k$ with $-L_k$ digits from its least significant digit in binary removed as a quantized spectral value $\hat{X}_k$;

for $\sim X_k$ with $L_k$ corresponding to $\sim X_k$ being a positive value, adopting $\sim X_k$ with $L_k$ digits added to its least significant digit in binary in accordance with a predefined rule as a quantized spectral value $\hat{X}_k$; and when $L_k$ corresponding to $\sim X_k$ is 0, adopting $\sim X_k$ as a quantized spectral value $\hat{X}_k$, wherein the predefined rule is a rule defined based on an order of sample numbers and an order of digit numbers such that removed digits become digits to be added without excess or deficiency.

9. An encoding method, by processing circuitry, comprising:

a log spectral envelope generating step for obtaining a log spectral envelope sequence $L_0, L_1, \ldots, L_{N-1}$, which is an integer value sequence corresponding to binary logarithms of respective sample values of a spectral envelope sequence corresponding to a time series signal in a predetermined time segment and is an integer value sequence whose total sum is 0, and an envelope code which is a code identifying the log spectral envelope sequence; and a signal smoothing step for obtaining a smoothed spectral sequence $\sim X_0, \sim X_1, \ldots, \sim X_{N-1}$ by:

with respect to a quantized spectral sequence $\hat{X}_0, \hat{X}_1, \ldots, \hat{X}_{N-1}$ obtained by quantization of respective sample values of a frequency domain spectral sequence for the time series signal, for $\hat{X}_k$ (k is sample number, where $k \in \{0, \ldots, N-1\}$) with $L_k$ corresponding to $\hat{X}_k$ being a positive value, adopting $\hat{X}_k$ with $L_1$ digits from its least significant digit in binary removed as the smoothed spectral value $\sim X_k$;

for $\hat{X}_k$ with $L_k$ corresponding to $\hat{X}_k$ being a negative value, adopting $\hat{X}_k$ with $-L_k$ digits added to its least significant digit in binary in accordance with a predefined rule as $\sim X_k$; and when $L_k$ corresponding to $\hat{X}_k$ is 0, adopting $\hat{X}_k$ as a smoothed spectral value $\sim X_k$, and for encoding respective samples of the obtained smoothed spectral sequence $\sim X_0, \sim X_1, \ldots, \sim X_{N-1}$ with a fixed code length to obtain a signal code, wherein the predefined rule is a rule defined based on an order of sample numbers and an order of digit numbers such that removed digits become digits to be added without excess or deficiency.

10. A decoding method, by processing circuitry, comprising:

a log spectral envelope decoding unit configured to decode an input envelope code to obtain a log spectral envelope sequence $L_0, L_1, \ldots, L_{N-1}$, which is an integer value sequence corresponding to binary logarithms of respective sample values of a spectral envelope sequence for a predetermined time segment and is an integer value sequence whose total sum is 0; and a signal inverse smoothing step for decoding a signal code which is a fixed-length code to obtain a smoothed spectral sequence $\sim X_0, \sim X_1, \ldots, \sim X_{N-1}$ for the predetermined time segment, and for the smoothed spectral sequence $\sim X_0, \sim X_1, \ldots, \sim X_{N-1}$, obtain a quantized spectral sequence $\hat{X}_0, \hat{X}_1, \ldots, \hat{X}_{N-1}$ which is a sequence of quantized spectra for the predetermined time segment by:

for $\sim X_k$ (k is sample number, where $k \in \{0, \ldots, N-1\}$) with $L_k$ corresponding to $\sim X_k$ being a negative value, adopting $\sim X_k$ with $-L_k$ digits from its least significant digit in binary removed as a quantized spectral value $\hat{X}_k$;

for $\sim X_k$ with $L_k$ corresponding to $\sim X_k$ being a positive value, adopting $\sim X_k$ with $L_k$ digits added to its least significant digit in binary in accordance with a predefined rule as a quantized spectral value $\hat{X}_k$; and when $L_k$ corresponding to $\sim X_k$ is 0, adopting $\sim X_k$ as a quantized spectral value $\hat{X}_k$, wherein the predefined rule is a rule defined based on an order of sample numbers and an order of digit numbers such that removed digits become digits to be added without excess or deficiency.

11. A smoothing method, by prcoessing circuitry, comprising:

a log spectral envelope generating unit configured to obtain a log spectral envelope sequence $L_0, L_1, \ldots, L_{N-1}$, which is an integer value sequence corresponding to binary logarithms of respective sample values of a spectral envelope sequence corresponding to a time series signal in a predetermined time segment and is an integer value sequence whose total sum is 0; and a smoothing unit configured to obtain a smoothed spectral sequence $\sim X_0, \sim X_1, \ldots, \sim X_{N-1}$ by:

with respect to a quantized spectral sequence $\hat{X}_0, \hat{X}_1, \ldots, \hat{X}_{N-1}$ obtained by quantization of respective sample values of a frequency domain spectral sequence for the time series signal, for $\hat{X}_k$ (k is sample number, where $k \in \{0, \ldots, N-1\}$) with $L_k$ corresponding to $\hat{X}_k$ being a positive value, adopting $\hat{X}_k$ with $L_1$ digits from its least significant digit in binary removed as the smoothed spectral value $\sim X_k$;

for $\hat{X}_k$ with $L_k$ corresponding to $\hat{X}_k$ being a negative value, adopting $\hat{X}_k$ with $-L_k$ digits added to its least significant digit in binary in accordance with a predefined rule as a smoothed spectral value $\sim X_k$; and when $L_k$ corresponding to $\hat{X}_k$ is 0, adopting $\hat{X}_k$ as a smoothed spectral value $\sim X_k$, wherein the predefined rule is a rule defined based on an order of sample numbers and an order of digit numbers such that removed digits become digits to be added without excess or deficiency.

12. An inverse smoothing method, by processing circuitry, comprising:

an inverse smoothing step for:

taking as input a log spectral envelope sequence $L_0, L_1, \ldots, L_{N-1}$, which is an integer value sequence corresponding to binary logarithms of respective sample values of a spectral envelope sequence for a predetermined time segment and is an integer value sequence whose total sum is 0, and a smoothed spectral sequence $\sim X_0, \sim X_1, \ldots, \sim X_{N-1}$ for the predetermined time segment, and for the smoothed spectral sequence $\sim X_0, \sim X_1, \ldots, \sim X_{N-1}$, obtain a quantized spectral sequence $\hat{X}_0, \hat{X}_1, \ldots, \hat{X}_{N-1}$ which is a sequence of quantized spectra for the predetermined time segment by:

for $\sim X_k$ (k is sample number, where $k \in \{0, \ldots, N-1\}$) with $L_k$ corresponding to $\sim X_k$ being a negative value, adopting $\sim X_k$ with $-L_k$ digits from its least significant digit in binary removed as a quantized spectral value $\hat{X}_k$;

for $\sim X_k$ with $L_k$ corresponding to $\sim X_k$ being a positive value, adopting $\sim X_k$ with $L_k$ digits added to its least significant digit in binary in accordance with a predefined rule as a quantized spectral value $\hat{X}_k$; and when $L_k$ corresponding to $\sim X_k$ is 0, adopting $\sim X_k$ as a quantized spectral value $\hat{X}_k$, wherein the predefined rule is a rule defined based on an order of sample numbers and an order of digit numbers such that removed digits become digits to be added without excess or deficiency.

13. A computer-readable recording medium storing a program for causing a computer to function as the encoding apparatus according to any one of claims 1 to 3.

14. A computer-readable recording medium storing a program for causing a computer function as the decoding apparatus according to any one of claims 4 to 6.

15. A computer-readable recording medium storing a program for causing a computer to function as the smoothing apparatus according to claim 7.

16. A computer-readable recording medium storing a program for causing a computer to function as the inverse smoothing apparatus according to claim 8.

* * * * *